US007804515B2

(12) United States Patent
Tamaru et al.

(10) Patent No.: US 7,804,515 B2
(45) Date of Patent: Sep. 28, 2010

(54) IMAGE-FORMING DEVICE WITH SCANNER UNIT

(75) Inventors: Yasuo Tamaru, Nagoya (JP); Hiroshi Igarashi, Nagoya (JP); Yasushi Okabe, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 6 days.

(21) Appl. No.: 12/320,328

(22) Filed: Jan. 23, 2009

(65) Prior Publication Data

US 2009/0141326 A1 Jun. 4, 2009

Related U.S. Application Data

(63) Continuation of application No. 11/156,466, filed on Jun. 21, 2005, now Pat. No. 7,586,508.

(30) Foreign Application Priority Data

| | | |
|---|---|---|
| Jun. 22, 2004 | (JP) | 2004-183860 |
| Jun. 22, 2004 | (JP) | 2004-183862 |
| Sep. 29, 2004 | (JP) | 2004-285073 |
| Oct. 29, 2004 | (JP) | 2004-317218 |

(51) Int. Cl.
*B41J 15/14* (2006.01)
*B41J 27/00* (2006.01)

(52) U.S. Cl. ..... 347/261; 347/243

(58) Field of Classification Search ..... 347/243, 347/259–261

See application file for complete search history.

(56) References Cited

U.S. PATENT DOCUMENTS

| | | | |
|---|---|---|---|
| 5,136,339 | A | 8/1992 | Morita et al. |
| 5,151,810 | A | 9/1992 | Blanding et al. |
| 5,216,475 | A | 6/1993 | Ohno |
| 5,237,348 | A | 8/1993 | Blanding et al. |
| 5,313,257 | A | 5/1994 | Kashima et al. |
| 5,461,461 | A | 10/1995 | Harasawa et al. |
| 5,557,384 | A | 9/1996 | Takano et al. |
| 5,559,590 | A | 9/1996 | Arai et al. |
| 5,640,660 | A | 6/1997 | Takano et al. |
| 5,659,843 | A | 8/1997 | Takano et al. |
| 5,666,622 | A | 9/1997 | Harasawa et al. |
| 5,867,760 | A | 2/1999 | Mitsuoka et al. |
| 5,897,241 | A | 4/1999 | Takano et al. |
| 5,903,803 | A | 5/1999 | Kawai et al. |

(Continued)

FOREIGN PATENT DOCUMENTS

| | | |
|---|---|---|
| JP | A 53-012335 | 2/1978 |

(Continued)

OTHER PUBLICATIONS

May 6, 2010 Office Action issued in Japanese Patent Application No. 2005-86332 (with translation).

*Primary Examiner*—Hai C Pham
(74) *Attorney, Agent, or Firm*—Oliff & Berridge, PLC

(57) ABSTRACT

An image-forming device includes: a housing; an endless belt; a plurality of process units; and a plurality of scanner units. Each scanner unit and each process unit are inclined obliquely to a vertical direction. At least a part of each process unit is inserted into and removed from the housing in an obliquely inclined direction.

13 Claims, 20 Drawing Sheets

U.S. PATENT DOCUMENTS

| | | | | |
|---|---|---|---|---|
| 5,978,617 | A | 11/1999 | Takano et al. | |
| 6,085,051 | A | 7/2000 | Miyasaka et al. | |
| 6,226,478 | B1 | 5/2001 | Watanabe et al. | |
| 6,240,266 | B1 | 5/2001 | Watanabe et al. | |
| 6,501,925 | B2 | 12/2002 | Yamamoto et al. | |
| 6,600,504 | B2 | 7/2003 | Okugawa et al. | |
| 6,639,621 | B2 * | 10/2003 | Tamaru | 347/257 |
| 6,708,011 | B2 | 3/2004 | Nomura et al. | |
| 6,856,335 | B2 * | 2/2005 | Ono | 347/115 |
| 6,922,534 | B2 | 7/2005 | Goto et al. | |
| 6,973,283 | B2 | 12/2005 | Sato et al. | |
| 7,184,070 | B2 | 2/2007 | Kaiho | |
| 7,242,888 | B2 | 7/2007 | Ishii | |
| 7,257,351 | B2 | 8/2007 | Tachiki et al. | |
| 2003/0059230 | A1 | 3/2003 | Yokoi et al. | |
| 2003/0147678 | A1 | 8/2003 | Ozawa et al. | |
| 2006/0079358 | A1 | 4/2006 | Igarashi | |

FOREIGN PATENT DOCUMENTS

| | | |
|---|---|---|
| JP | U 60-170340 | 11/1985 |
| JP | A 61-116366 | 6/1986 |
| JP | A 02-163762 | 6/1990 |
| JP | A 04-329557 | 11/1992 |
| JP | A 05-072837 | 3/1993 |
| JP | A 05-162881 | 6/1993 |
| JP | A 05-229686 | 9/1993 |
| JP | A 06-003919 | 1/1994 |
| JP | A 06-183056 | 7/1994 |
| JP | A 07-234622 | 9/1995 |
| JP | A 07-304540 | 11/1995 |
| JP | A 07-306603 | 11/1995 |
| JP | A 08-069241 | 3/1996 |
| JP | A 08-087151 | 4/1996 |
| JP | A 08-190245 | 7/1996 |
| JP | A-8-328449 | 12/1996 |
| JP | A 09-197736 | 7/1997 |
| JP | A 09-204083 | 8/1997 |
| JP | A 09-235041 | 9/1997 |
| JP | A 09-325544 | 12/1997 |
| JP | A 10-186775 | 7/1998 |
| JP | A 10-194530 | 7/1998 |
| JP | A 10-198118 | 7/1998 |
| JP | A 11-095520 | 4/1999 |
| JP | A 11-143335 | 5/1999 |
| JP | A 11-327246 | 11/1999 |
| JP | A 11-338216 | 12/1999 |
| JP | A 2000-172041 | 6/2000 |
| JP | A 2000-267380 | 9/2000 |
| JP | A 2000-275987 | 10/2000 |
| JP | A 2000-280570 | 10/2000 |
| JP | A-2001-61037 | 3/2001 |
| JP | A 2001-133718 | 5/2001 |
| JP | A 2001-222207 | 8/2001 |
| JP | A 2001-228664 | 8/2001 |
| JP | A 2001-228722 | 8/2001 |
| JP | A 2001-249601 | 9/2001 |
| JP | A 2001-331003 | 11/2001 |
| JP | A 2001-341890 | 12/2001 |
| JP | A 2001-350307 | 12/2001 |
| JP | A 2002-108172 | 4/2002 |
| JP | A 2002-139926 | 5/2002 |
| JP | A 2002-166591 | 6/2002 |
| JP | A 2002-174940 | 6/2002 |
| JP | A 2002-318494 | 10/2002 |
| JP | A 2002-323833 | 11/2002 |
| JP | A 2003-072136 | 3/2003 |
| JP | B2 3408221 | 3/2003 |
| JP | A 2003-107838 | 4/2003 |
| JP | A 2003-131472 | 5/2003 |
| JP | A 2003-173066 | 6/2003 |
| JP | A 2003-195726 | 7/2003 |
| JP | A 2003-248380 | 9/2003 |
| JP | A 2003-248381 | 9/2003 |
| JP | A 2003-248389 | 9/2003 |
| JP | A 2003-280489 | 10/2003 |
| JP | A 2004-109466 | 4/2004 |
| JP | A 2004-144918 | 5/2004 |
| JP | A-2004-151432 | 5/2004 |
| JP | A 2004-168534 | 6/2004 |
| JP | A 2004-217331 | 8/2004 |
| JP | A 2004-301944 | 10/2004 |
| JP | A-2004-302375 | 10/2004 |
| JP | A-2005-62274 | 3/2005 |

* cited by examiner

401

IMAGE-FORMING DEVICE WITH SCANNER UNIT

CROSS-REFERENCE TO RELATED APPLICATION

This is a Continuation of application Ser. No. 11/156,466 filed Jun. 21, 2005. The disclosure of the prior application is hereby incorporated by reference herein in its entirety.

BACKGROUND

1. Field of the Invention

The present invention relates to an image-forming device that forms an image on a recording medium and, in particular, to an image-forming device which is provided with a plurality of scanner units and process units and which is also provided with a belt for image formation that conveys a developer image or a recording medium.

2. Description of Related Art

There has been proposed an image-forming device of a type that is provided with: an endless belt that conveys a developer image or a recording medium; a plurality of process units provided with a plurality of photosensitive drums for a plurality of colors so that each photosensitive drum faces the belt; a plurality of scanner units, each of which is for exposing and scanning the surface of the corresponding photosensitive drum to form an electrostatic latent image, which is developed by a corresponding process unit by using a developer of the corresponding color; and a transfer unit that transfers the developer image formed on the surface of each of the photosensitive drums, either onto the recording medium that is conveyed by the belt or onto the belt itself.

US Patent Application Publication No. US2003/0147678A1 has proposed an image-forming device of a type, in which the belt is an intermediate transfer belt for supporting a developer. This type of image-forming device performs an image formation process in a manner described below.

When a scanner unit exposes and scans the corresponding photosensitive drum for one color in accordance with image data to form an electrostatic latent image, a corresponding process unit develops the electrostatic latent image by using a developer of the color. The developer image is transferred to the intermediate transfer belt by a transfer roller. Once developer images for all the colors have been superimposed thereon, the developer images are transferred to a recording medium.

Japanese Patent Laid-Open No. 7-234622 has proposed another type of image-forming device, wherein the endless belt is a conveyor belt for conveying a recording medium. In this type of image-forming device, developer images are superimposed directly onto a recording medium, while the recording medium is being conveyed by the conveyor belt, to form the superimposed images on the recording medium.

SUMMARY

An object of the present invention is to provide an image-forming device which can easily be made compact and which has superior maintainability relating to the process units thereof.

In order to attain the above and other objects, the present invention provides an image-forming device including: a housing; an endless belt; a plurality of process units; a plurality of scanner units; and a transfer portion. The endless belt is mounted in the housing and conveys either one of a developer image and a recording medium. The plurality of process units are mounted in the housing in one to one correspondence with a plurality of colors, the plurality of process units including a plurality of photosensitive drums, respectively, each photosensitive drum facing the endless belt. The plurality of scanner units are mounted in the housing and are provided one for each of the photosensitive drums, each scanner unit scanning with light the surface of the corresponding photosensitive drum to form an electrostatic latent image, each process unit developing the electrostatic latent image by using a developer of the corresponding color. The transfer portion is mounted in the housing and transfers the developer image, formed on the surface of each of the photosensitive drums, onto either one of the endless belt and the recording medium that is conveyed by the endless belt. The scanner units and the process units are disposed alternately in a horizontal direction. Each scanner unit and each process unit are inclined obliquely to a vertical direction. At least a part of each process unit is inserted into and removed from the housing in an obliquely inclined direction.

According to another aspect, the present invention provides a belt unit that can be detachably mounted in an image forming device, the belt unit including: a belt unit frame; a plurality of rollers; and an endless belt. The belt unit frame can be moved along a linear insertion/removal path defined for an image forming device including a plurality of photosensitive drums and that can be installed in the image forming device at an installation position defined on the insertion/removal path, the belt unit frame can be moved toward the installation position in the image forming device along the insertion/removal path in an insertion direction, the belt unit frame can be moved from the installation position along the insertion/removal path in a removal direction. The plurality of rollers are supported by the belt unit. The endless belt is supported by the rollers, the endless belt being capable of moving circumferentially around the plurality of rollers to convey either one of an image and a recording medium, a surface of the endless belt contacting the photosensitive drums when the belt unit frame is located in the installation position in the image forming device. The direction of motion of the endless belt at a contact position of the endless belt with each photosensitive drum and the withdrawal direction form an angle that causes the contact between the surface of the endless belt and each photosensitive drum to be released when the belt unit starts being moved in the withdrawal direction from the installation position.

BRIEF DESCRIPTION OF THE DRAWINGS

The above and other objects, features and advantages of the invention will become more apparent from reading the following description of the preferred embodiments taken in connection with the accompanying drawings in which.

DETAILED DESCRIPTION OF EMBODIMENTS

Figure 1:
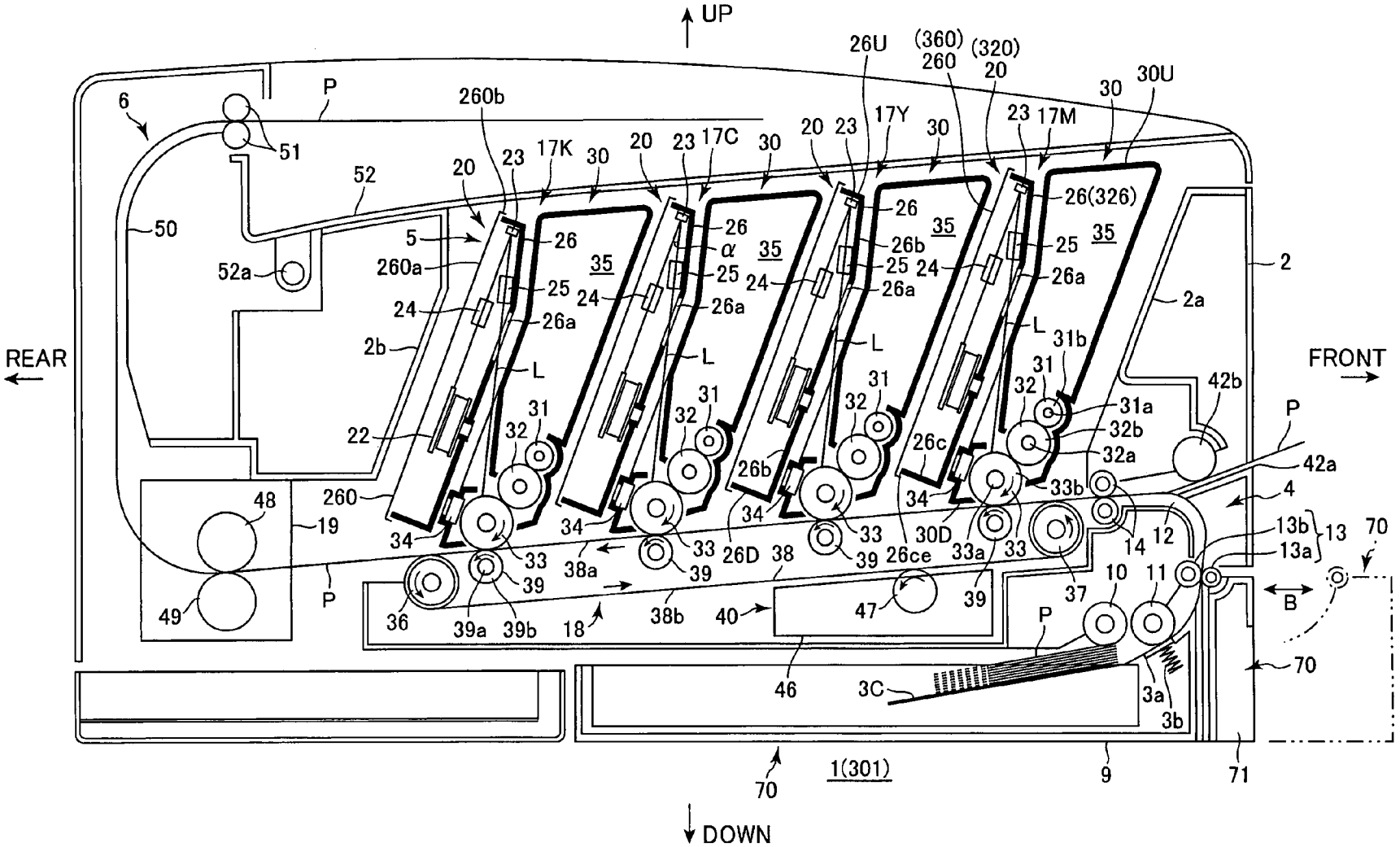
FIG. 1 is a side sectional view of the overall configuration of a color laser printer according to a first embodiment of the present invention.

An image-forming device according to preferred embodiments of the present invention will be described while referring to the accompanying drawings wherein like parts and components are designated by the same reference numerals to avoid duplicating description.

First Embodiment

First, a color laser printer 1 according to a first embodiment will be described with reference to FIG. 1-FIG. 8.

In the following description, the expressions "front", "rear", "upper" "lower", "right", and "left" are used to define the various parts when the color laser printer 1 is disposed in an orientation in which it is intended to be used.

The color laser printer 1 is of a horizontal-tandem type, in which a plurality of image-forming portions 17 are arranged in line along a horizontal direction. The laser printer 1 has a main casing 2, in which a sheet supplying section 4, an image forming section 5, and a sheet discharging section 6 are provided.

The sheet supplying section 4 is for supplying a sheet of paper P as a recording medium. The image forming section 5 is for forming an image on the sheet of paper P supplied from the sheet supplying section 4. The sheet discharging section 6 is for discharging the sheet of paper P formed with images by the image forming section 5.

The main casing 2 acts as a housing of the color laser printer 1. The main casing 2 is of a box shape with its upper opening being covered by a sheet-discharge tray 52. Thus, the sheet-discharge tray 52 serves as a top cover. The sheet-discharge tray 52 is supported rotatably via a hinge 52*a* to the main casing 2, and is openable and closable with respect to the main casing 2.

The sheet supplying section 4 is located in a lower portion of the main casing 2, and includes: a paper tray 9; a support plate 3*c*; a separation pad 3*a*; a spring 3*b*; a pair of paper supply rollers 10 and 11; a sheet supply cassette frame 71; a pair of conveyor rollers 13 (front conveyor roller 13*a* and rear conveyor roller 13*b*); a paper supply side U-shaped path 12; and a pair of registration rollers 14. The paper tray 9, support plate 3*c*, separation pad 3*a*, spring 3*b*, and front conveyor roller 13*a* are mounted on the sheet supply cassette frame 71, and are integrated together as an integral unit into a sheet supply cassette 70. The sheet supplying section 4 further includes a paper supply port 42*a*.

The image-forming section 5 includes: four image forming portions 17 (17M, 17Y, 17C, and 17K); a transferring section 18; and a fixing section 19.

The image forming portion 17M is for forming a magenta toner image, the image forming portion 17Y is for forming a yellow toner image, the image forming portion 17C is for forming a cyan toner image, and the image forming portion 17K is for forming a black toner image. The image-forming portions 17M, 17Y, 17C, and 17K are disposed slightly above the center of the main casing 2 in the vertical direction.

Each image-forming portion 17 has a scanner unit 20 and a process cartridge 30. The scanner unit 20 is supported on a scanner support frame 260, which is in turn fixedly secured to the main casing 2. As described later, the orientation of the scanner unit 20 with respect to the scanner support frame 260 is adjustable.

The transfer section 18 is disposed in the main casing 2 above the sheet supply section 4 and below the image-forming portions 17, and extends along the front-to-rear direction. The transfer section 18 includes: a drive roller 36, a follower roller 37, a conveyer belt 38, a plurality of transfer rollers 39, and a belt cleaning unit 40. The conveyor belt 38 is disposed below the four image-forming portions 17 and confronts the four image-forming portions 17.

The fixing section 19 is disposed rearward of the transfer section 18. The fixing section 19 includes a heating roller 48 and a pressure roller 49.

The sheet discharging section 6 has a sheet discharge side U-shaped path 50, a pair of sheet discharge rollers 51, and the sheet discharge tray 52.

Sheet Supplying Section

The sheet supplying section 4 will be described below in greater detail.

In the sheet supplying section 4, the sheet supply cassette 70 is mounted in the main casing 2 in a detachable manner. The sheet supply cassette 70 can be pulled out from a storage position that is indicated by a solid line in FIG. 1 toward a pulled-out position that is indicated by a two-dots-and-chain line in the same figure, in which state some recording paper P can be replenished as appropriate. In this way, the sheet supply cassette 70 can be inserted and removed horizontally from the front of the main casing 2.

The sheet supply cassette 70 has the paper tray 9. The support plate 3*c* is mounted on the paper tray 9. The support plate 3*c* is urged upward by a spring (not shown in the figure), which is also mounted on the paper tray 9.

Note that the various rollers except for the front conveyer roller 13*a* are provided in a rotatable manner at predetermined positions of the main casing 2 and are driven by a drive source (not shown), which also serves to drive the image-forming portions 17M, 17Y, 17C, and 17K.

The separation pad 3*a* and the spring 3*b* are mounted in the sheet supply cassette 70.

The pair of paper supply rollers 10 and 11 are mounted in the main casing 2 at locations upward from the support plate 3*c*.

The separation pad 3*a* is pressed into contact with the paper supply roller 11 by the spring force of the spring 3*b* when the sheet supply cassette 70 is mounted in the main casing 2 at a predetermined position.

The paper supply rollers 10 and 11 separate the recording papers P that are held in a stack on the support plate 3*c* one sheet at a time and supply the separated sheet in a direction toward the conveyor rollers 13. More specifically, the paper supply roller 10, which is located on the rear side among the pair of paper supply rollers 10 and 11, conveys the uppermost sheet of the recording paper P in the stack on the support plate 3*c* towards the paper supply roller 11, and the paper supply roller 11 on the front side is pressed against the separation pad 3*a* to separate one sheet of the recording paper P at a time and convey the same. The paper supply roller 10 serves as a pickup roller.

Among the pair of conveyor rollers 13, the front conveyor roller 13*a* is mounted in the sheet supply cassette 70, while the rear conveyor roller 13 is mounted in the main casing 2. The pair of conveyor rollers 13 cooperate to convey the recording paper P.

The pair of conveyor rollers 13 and a pair of registration rollers 14 are disposed sequentially along the paper supply side U-shaped path 12, along which the recording paper P is conveyed from the paper supply roller 11 to the image-forming portions 17. Before the image-forming portions 17 start their image-forming operations, the registration rollers 14 temporarily halt conveying the recording paper P, correct the orientation of the recording paper P by catching the leading edge thereof, and send the recording paper P to the image-forming portions 17.

The paper supply side U-shaped path 12 serves as a U-shaped conveying path for conveying the sheets. The paper supply side U-shaped path 12 extends upwardly from its upstream side edge through its middle portion toward its downstream side edge.

In this embodiment, the paper supply side U-shaped path 12 is located at its upstream side edge adjacent to the sheet supply roller 11, and conveys sheets forwardly at the upstream side edge. The conveyor rollers 13 are located in the middle portion of the paper supply side U-shaped path 12. The paper supply side U-shaped path 12 is located at its downstream side edge adjacent to the registration rollers 14, and conveys sheets rearwardly.

Thus, the sheet of paper P is first conveyed in the forward direction at the upstream side edge of the paper supply side U-shaped path 12, and is conveyed by the conveyor rollers 13 in the middle of the paper supply side U-shaped path 12. While the sheet of paper P is conveyed by the conveyor rollers 13 in the middle of the paper supply side U-shaped path 12, the conveying direction of the sheet of paper P is reversed. The sheet of paper P is then sent out from the paper supply side U-shaped path 12 in the rearward direction after being adjusted in its orientation by the registration rollers 14.

The paper supply port 42*a* is for manually supplying a recording paper P to the color laser printer 1. The paper supply port 42*a* is located in a lower section of the main casing 2 on the front side thereof, on which the sheet supply cassette 70 is pulled out. A recording paper P supplied from the paper supply port 42*a* is conveyed by a paper supply roller 42*b* to the nip portion between the registration rollers 14, where the paper P is adjusted in its orientation before being sent to the image-forming portions 17.

Image Forming Section 5

Next, the image forming section 5 will be described in greater below.

In the image forming section 5, the four image forming portions 17M, 17Y, 17C, and 17K are arranged in this order from the front to the rear in the front-to-rear direction. In each image forming portion 17, a corresponding scanner unit 20 and a corresponding process cartridge 30 are mounted in the main casing 2. The scanner unit 20 is fixedly mounted in the main casing 2, with its orientation being adjustable. The process cartridge 30 is detachably mounted in the main casing 2. When the process cartridges 30 are mounted in all the image forming portions 17, the scanner units 20 and the process cartridges 30 are arranged alternately in the front-to-rear direction.

The scanner units 20 are disposed at an angle with the upper ends thereof inclined forward. When the process cartridges 30 are mounted in the image forming portions 17, the process cartridges 30 are disposed also at an angle with the upper ends thereof inclined forward. The process cartridges 30 are inclined substantially at the same angle with the scanner units 20 with respect to the front-to-rear (horizontal) direction.

More specifically, the main casing 2 has a front inner wall 2*a* and a rear inner wall 2*b*, both of which are slanted to extend forwardly upwardly. The four scanner support frames 260 are disposed between the front inner wall 2*a* and rear inner wall 2*b*, and are also slanted to extend forwardly upwardly. The scanner support frames 260, the front inner wall 2*a*, and the rear inner wall 2*b* extend substantially parallel with one another. The scanner units 20 are mounted on the scanner support frames 260 to extend along the scanner support frames 260.

When the process cartridges 30 for all the colors are mounted in the casing 2, the process cartridge 30 for black is located between the scanner unit 20 for black and the scanner support frame 260 for cyan to extend along the scanner support frame 260 for cyan, the process cartridge 30 for cyan is located between the scanner unit 20 for cyan and the scanner support frame 260 for yellow to extend along the scanner support frame 260 for yellow, the process cartridge 30 for yellow is located between the scanner unit 20 for yellow and the scanner support frame 260 for magenta to extend along the scanner support frame 260 for magenta, and the process cartridge 30 for magenta is located between the scanner unit 20 for magenta and the front inner side wall 2*a* to extend along the front inner side wall 2*a*.

Next, the image-forming portions 17 will be described in greater below. The image-forming portions 17 (17M, 17Y, 17C, and 17K) have the same configurations with one another.

Each process cartridge 30 is mounted with: a supply roller 31; a developing roller 32; a photosensitive drum 33; a Scorotron charger 34; and a toner box 35.

The photosensitive drum 33 is rotatably supported in the process cartridge 30 at a lower end thereof.

The photosensitive drum 33 includes: a main drum body 33*b* that is cylindrical in shape; and a drum shaft 33*a* extending along the axial center of the main drum body 33*b* in its axial direction thereof. The process cartridge 30 is mounted in the main casing 2 with the drum shaft (rotational shaft) 33*a* extending in the widthwise direction of the main casing 2. The main drum body 33*b* has, on its outer surface, a photosensitive layer formed of polycarbonate or the like that has a positively charging nature. The drum shaft 33*a* is fixedly secured to both of the widthwise side plates (right-side and left-side plates) configuring the process cartridge 30. The drum shaft 33*a* is unable to rotate relative to the side plates. The main drum body 33*b* is rotatably supported on the drum shaft 33*a*. In this way, the photosensitive drum 33 is rotatably supported in the process cartridge 30.

During an image formation process, the photosensitive drum 33 is driven to rotate in the clockwise direction in the figure, and therefore moves in the same direction with the conveyor belt 38 at its position where the photosensitive drum 33 contacts the conveyer belt 38.

The Scorotron charger 34 is of a positively charging type, and has a wire and a grid for generating a corona discharge. The Scorotron charger 34 is disposed rearward of the photosensitive drum 33. The Scorotron charger 34 is in opposition to but is separate a distance from the photosensitive drum 33 so as not to contact the same.

The developing roller 32 is disposed above and in opposition to the photosensitive drum 33. The developing roller 32 is pressed against the photosensitive drum 33. The developing roller 32 has a metal roller shaft 32*a* covered with a roller 32*b* made from an elastic material, specifically a conductive rubber material. More specifically, the roller part 32*b* of the developing roller 32 has a two-layer configuration including: an elastic roller part which is made from a conductive urethane rubber, silicone rubber, or EPDM rubber and which contains carbon powder; and a coating layer, which is made mainly of urethane rubber, urethane resin, or polyimide resin. The roller shaft 32*a* is rotatably supported by the pair of widthwise side plates of the process cartridge 30.

The supply roller 31 is disposed above and in opposition to the developing roller 32. The supply roller 31 is configured of a metal roller shaft 31*a* that is covered by a roller 31*b* formed of a conductive foam material. The roller shaft 31*a* is rotatably supported on both of the widthwise side walls of the process cartridge 30.

The toner tank 35 is defined in the process cartridge 30 at an upper portion of the supply roller 31. The toner tank 35 in the process cartridge 30 of the image-forming portion 17M stores therein magenta toner. The toner tank 35 in the process cartridge 30 of the image-forming portion 17Y stores therein yellow toner. The toner tank 35 in the process cartridge 30 of the image-forming portion 17C stores therein cyan toner. The toner tank 35 in the process cartridge 30 of the image-forming portion 17K stores therein black toner. The toner is a non-magnetic single component polymer toner with a positive charging nature.

In the embodiment, each color toner is a polymer toner with substantially spherical particles.

The polymer toners include binding resins as their main component. Each binding resin is made by copolymerizing a polymerizing monomer using a well-known polymerization method such as suspension polymerization. Examples of polymerizing monomers include styrene monomers, such as styrene, and acrylic monomers, such as acrylic acid, alkyl (C1-C4)acrylate, and alkyl(C1-C4)meta-acrylate.

Main toner particles are formed by adding coloring agents, charge regulators, and wax to the binding resins. In the present embodiment, the coloring agents are yellow, magenta, cyan, and black coloring agents. Examples of charge regulators that can be used include a charge regulating resin obtained by copolymerizing an ionic monomer with a copolymerizing monomer. In this case, the ionic monomer can be an ammonium salt or other monomer with an ionic functional group. The copolymerizing monomer is capable of copolymerizing with the ionic monomer and can be a styrene monomer, an acrylic monomer, or other monomer with an ionic functional group.

An external additive, such as silica, is added to the main toner particles for the purpose of increasing fluidity of the toners. Powders of various inorganic materials can be used as an external additive. For example, powders of a metallic oxide, a carbide, or a metallic salt can be used as an external additive. Examples of a metallic oxide powder that can be used as an external additive include silica, aluminum oxide (alumina), titanium oxide, strontium titanate, cerium oxide, magnesium oxide.

The scanner unit 20 includes: a scanner housing 26; and various optical components mounted in the scanner housing 26. The optical components include: a laser diode (not shown in the figure) that emits a laser beam L; a polygon mirror 22 that deflects the laser beam L along a scanning direction that is orthogonal to the sheet of FIG. 1; an fθ lens 24 that transmits the laser beam L from the polygon mirror 22; a fold-back mirror 23 that receives the laser beam L deflected by the polygon mirror 22 and reflects the laser beam L back towards the photosensitive drum 33 of the corresponding process cartridge 30, and a cylindrical lens 25 that transmits the laser beam L reflected from the fold-back mirror 23.

Note that the scanner housing 26 is formed with an exposure aperture 26*a* on the corresponding process cartridge 30 side. An optical component such as a protective glass is provided on the scanner housing 26 to cover the exposure aperture 26*a*.

The fold-back mirror 23 is provided near the upper end of the process cartridge 30, with an angle α of approximately 15 degrees being formed, along an imaginary plane (plane parallel to the sheet of drawing) that is perpendicular to the scanning direction, between the optical path of the laser beam L between the fθ lens 24 and the fold-back mirror 23 and the optical path of the laser beam L between the fold-back mirror 23 and the cylindrical lens 25.

This ensures that the scanner unit 20 and the process cartridge 30 are disposed in close proximity, so that the entire device 1 can be made compact. The length of the optical path of the laser beam L required to expose the photosensitive drum 33 from the vicinity of the upper end of the scanner unit 20 to the photosensitive drum 33 in the vicinity of the lower end of the process cartridge 30 can be sufficiently guaranteed. Components such as the fθ lens 24 can be made compact so that the entire device 1 can be made compact.

In addition, since the laser beam L is reflected at the vicinity of the upper end of the scanner unit 20, the exposure aperture 26*a* can be disposed at a location that is above the vertical center of the scanner unit 20 and therefore that is sufficiently away from the photosensitive drum 33, which is located at the lower end of the process cartridge 30. The protective glass that covers the exposure aperture 26*a* can be prevented from being contaminated by toner.

In each image-forming portion 17, during an image forming process, a laser beam L is emitted from the laser diode (not shown) according to image data and is deflected by the polygon mirror 22, and is reflected off by the fold-back mirror 23.

The laser beam L then exits out of the scanner unit 20 through the exposure aperture 26*a* and reaches the photosensitive drum 33.

Toner stored in the toner tank 35 is supplied to the supply roller 31. As the supply roller 31 rotates, the toner is supplied to the developing roller 32. While the toner is being supplied from the supply roller 31 to the developing roller 32, the toner is charged to a positive polarity due to a friction between the supply roller 31 and the developing roller 32, which is applied with a developing bias.

The scorotron charger 34 is applied with a charging bias to generate a corona discharge, thereby electrically charging the surface of the photosensitive drum 33 uniformly to a positive polarity. As the photosensitive drum 33 rotates, the surface of the photosensitive drum 33 that has been charged to a positive polarity is exposed to a high-speed scan of a laser beam from the scanner unit 20. As a result, an electrostatic latent image corresponding an image desired to be formed on a paper is formed on the surface of the photosensitive drum 33.

As the photosensitive drum 33 further rotates, the positively-charged toner that is born on the surface of the developing roller 32 is brought into contact with the photosensitive drum 33. At this time, the toner on the developing roller 32 is supplied to lower-potential areas of the electrostatic latent image on the photosensitive drum 33 that have been exposed to the laser beam. As a result, the toner is selectively borne on the photosensitive drum 33 so that the electrostatic latent image is developed into a visible toner image.

Each process cartridge 30 is installed in the main casing 2 as being inclined towards the front at a position that is higher than its neighboring process cartridge 30 in the rear side thereof. More specifically, the installation position of each process cartridge 30 is offset by a predetermined amount higher than that of its rear-side neighboring process cartridge 30.

More specifically, the offset between the installation position of the process cartridge 30 in the black image-forming portion 17K and the installation position of the process cartridge 30 in the cyan image-forming portion 17C, the offset between the installation position of the process cartridge 30 in the cyan image-forming portion 17C and the installation position of the process cartridge 30 in the yellow image-forming portion 17Y, and the offset between the installation position of the process cartridge 30 in the yellow image-forming portion 17Y and the installation position of the process cartridge 30 in the magenta image-forming portion 17M are all equal to the predetermined amount.

This ensures that when the process cartridges 30 for all the colors are installed in the image forming section 5 of the main casing 2, the photosensitive drums 33 in the process cartridges 30 are arranged with a line connecting the lower sides of the photosensitive drums 33 extending forwardly upwardly at a predetermined angle with respect to the horizontal direction. Accordingly, a space defined below the image forming section 5 and above the sheet supply cassette 70 has a tapered shape in which the height in the vertical direction narrows towards the rear as seen from the side. The transfer portion 18 is provided in this space of a tapered shape.

Next, the transferring section 18 will be described in detail.

The drive roller 36 is disposed rearward from the photosensitive drum 33 of the process cartridge 30 installed in the black image-forming portion 17K. The drive roller 36 is disposed at a position that is entirely shifted from the photosensitive drum 33 in the vertical direction. During image formation, the drive roller 36 is driven to rotate in the direction opposite to that of the photosensitive drum 33 (counterclockwise in the figure).

The follower roller 37 is disposed forward from the photosensitive drum 33 of the process cartridge 30 that is installed in the magenta image-forming portion 17M. The follower roller 37 is disposed at a position higher than the drive roller 36. When the drive roller 36 rotates, the follower roller 37 rotates (counterclockwise in the figure) with its portion that is in contact with the conveyor belt 38 moving in the same direction as the direction of motion of the conveyor belt 38.

Each process cartridge 30 is installed with the axial direction of the photosensitive drum 33 being substantially parallel with the axial directions of the drive roller 36 and of the follower roller 37.

The conveyor belt 38 is an endless belt formed of a resin such as an electrically conductive polycarbonate or polyimide in which are dispersed electrically conductive particles such as those of carbon. The conveyor belt 38 is wound around the drive roller 36 and the follower roller 37. The conveyor belt 38 has: an upper-side portion 38*a* that is disposed in the upper side of the drive roller 36 and the follower roller 37; and a lower-side portion 38*b* that is disposed in the lower side of the drive roller 36 and the follower roller 37. Both of the upper-side portion 38*a* and the lower-side portion 38*b* extend in a flat slope or inclination that increases in height toward the front. When each process cartridge 30 is installed in the main casing 2, the upper-side portion 38*a* of the conveyor belt 38 becomes in contact with the photosensitive drum 33 of the process cartridge 30 from below. The contact portion between the photosensitive drum 33 and the upper-side portion 38*a* of the conveyor belt 38 will be referred to as an image transfer position hereinafter.

It is noted that the follower roller 37 is disposed on the upstream side in the direction of motion of the upper-side portion 38*a* of the conveyor belt 38, and the drive roller 36 on the downstream side. On the other hand, the follower roller 37 is disposed on the downstream side in the direction of motion of the lower-side portion 38*b* of the conveyor belt 38, and the drive roller 36 on the upstream side.

When the drive roller 36 rotates in the counterclockwise direction, the conveyor belt 38 moves circumferentially around the drive roller 36 and the follower roller 37 to rotate in the counterclockwise direction, with the upper side portion 38*a* moving in the same direction as the photosensitive drums 33 at its image transfer positions. The drive roller 36 is disposed on the downstream side and the driven roller 37 is disposed on the upstream side in the direction of motion of the upper side portion 38*a* of the conveyor belt 38 at the image transfer positions. Accordingly, slackening can be prevented in the upper side portion 38*a* of the conveyor belt 38. For that reason, the paper P can be conveyed accurately by the upper side portion 38*a* of the conveyor belt 38.

Four transfer rollers 39 are disposed in between the upper side portion 38*a* and the lower side portion 38*b* of the conveyor belt 38. The transfer rollers 39 are located at the image transfer positions where the upper side portion 38*a* of the conveyor belt 38 contacts the photosensitive drums 33. Each transfer roller 39 faces the corresponding photosensitive drum 33 with the upper side portion 38*a* being sandwiched therebetween.

Each transfer roller 39 has a metal roller shaft 39*a* covered with a roller portion 39*b* formed of an elastic substance such as an electrically conductive rubber material. Both end portions of the roller shaft 39*a* of each transfer roller 39 are rotatably supported in the main casing 2 via bearings and compression springs (not shown).

The transfer rollers 39 are pressed by the compression springs (not shown) upwardly, thereby pressing the conveyor belt 38 against the photosensitive drum 33 at each image transfer position. A nip is formed between the photosensitive drum 33 and the conveyor belt 38 at each image transfer position.

Transfer bias is applied to each transfer roller 39. Each transfer roller 39 rotates counterclockwise in the figure, and therefore moves in the same direction as the conveyor belt 38 at its image transfer position.

The paper P that has been supplied from the paper supply portion 4 is conveyed from the front to the rear by the conveyor belt 38, which is moved circumferentially by the driving of the drive roller 36 and movement of the driven roller 37, to sequentially pass the image transfer positions between the conveyor belt 38 and the photosensitive drum 33 of the image-forming portions 17. During the conveying, a toner image of each color that is supported on the corresponding photosensitive drum 33 of each image-forming portion 17 is sequentially transferred to the paper P, and thus a multi-color image is formed on the paper P.

In other words, a multi-color image can be formed on the paper P by first transferring a magenta toner image, which is supported on the surface of the photosensitive drum 33 of the magenta image-forming portion 17M, onto the paper P, then transferring a yellow toner image, which is supported on the surface of the photosensitive drum 33 of the yellow image-forming portion 17Y, onto the magenta toner image that has already been transferred to the paper P, and similarly transferring a cyan toner image, supported on the surface of the photosensitive drum 33 of the cyan image-forming portion 17C, and a black toner image, supported on the surface of the photosensitive drum 33 of the black image-forming portion 17K, onto the previous images thereon.

The belt cleaning device 40 is disposed below the conveyor belt 38 in a comparatively large space that is formed near to the follower roller 37 side, that is, in the space that is larger than that formed near to the drive roller 36 side.

The belt cleaning device 40 has a cleaning box 46 and a cleaning roller 47.

The cleaning box 46 has a box shape, and is formed with an aperture at its part that faces the lower side portion 38*b* of the conveyor belt 38. The interior space of the cleaning box 46 is formed as a collection portion for collecting objects that have been attached to the conveyor belt 38 and that are removed from the conveyor belt 38 by the cleaning roller 47.

The cleaning roller 47 is a metal roller that is rotatably supported in the cleaning box 46 at its aperture portion, and is in contact with the lower surface of the lower side portion 38*b* of the conveyor belt 38. During the cleaning operation, a cleaning bias is applied to the cleaning roller 47. The cleaning roller 47 is driven to rotate in the counterclockwise direction in the figure. Accordingly, the cleaning roller 47 moves in a direction opposite to the direction of motion of the conveyor belt 38 at its portion where the cleaning roller 47 contacts the conveyor belt 38.

It is noted that toner adheres to the conveyor belt 38 when the conveyor belt 38 contacts the photosensitive drum 33. Paper dust adheres to the conveyor belt 38 when the paper P contacts the conveyor belt 38. Objects such as those toner and paper dust are captured by the cleaning roller 47 by an electrostatic force when the conveyor belt 38 brings the objects at a location opposing the cleaning roller 47. The thus-captured objects are removed from the cleaning roller 47 to be collected in the collection portion within the cleaning box 46.

In this way, when the cleaning roller 47 comes into contact with the outer or lower surface of the lower side portion 38*b* of the conveyor belt 38, the cleaning roller 47 recovers toner that has been adhered to the surface of the conveyor belt 38 when the toner has scattered from the photosensitive drum 33 and paper dust that has been adhered to the surface of the conveyor belt 38 when the paper P has been conveyed on the conveyor belt 38.

The fixing section 19 will be described below.

The heating roller 48 is configured of a metal tube with a release layer formed on the surface thereof. The heating roller 48 accommodates therein a halogen lamp extending along the direction of the axis of the heating roller 48. The halogen lamp heats the surface of the heating roller 48 to a fixing temperature. The pressure roller 49 contacts the heating roller 48 with pressure.

In this fixing portion 19, the recording paper P with the toner image formed thereon is sandwiched between the heating roller 48 and the pressure roller 49, and the toner image is thermally fixed onto the sheet of paper P with pressure.

Sheet Discharging Section 6

The sheet discharge side U-shaped path 50 is formed as a substantially U-shaped conveying path for the paper P, which extends upward from its upstream end portion toward its downstream end portion. The upstream end portion of the sheet discharge side U-shaped path 50 is in the vicinity of the fixing portion 19 and conveys the paper P rearward. The downstream end portion of the sheet discharge side U-shaped path 50 is in the vicinity of the sheet discharge tray 52, and conveys the paper P forward.

The sheet discharge rollers 51 are provided as a pair of rollers at the end of the downstream side of the sheet discharge side U-shaped path 50.

The sheet discharge tray 52 defines the upper surface of the main casing 2 as an inclined wall that slopes downward from front to rear.

The paper conveyed from the fixing portion 19 is supplied rearward in the upstream end portion of the sheet discharge side U-shaped path 50, is reversed in its conveying direction within the sheet discharge side U-shaped path 50, and is delivered forward onto the sheet discharge tray 52 by the sheet discharge rollers 51.

The sheet discharge tray 52 is configured so that the entire tray can rotate about the center of the hinge 52*a* that is provided below the sheet discharge rollers 51. Each process cartridge 30 can be removed from the main casing 2 by rotating this sheet discharge tray 52 upward to open the device, as shown in FIG. 2.

As described above, according to the present embodiment, the color laser printer 1 is of a tandem type, in which a plurality of process cartridges 30 (one for each color) are provided in the plurality of image forming portions 17, respectively. Accordingly, the formation of an image for each color is executed at substantially the same speed as that of a monochromatic image, making it possible to form a multi-color image rapidly. For that reason, a multi-color image can be formed, while keeping the device compact.

More specifically, the photosensitive drum 33 is rotatably supported in each process cartridge 30 in the vicinity of the lower end of the process cartridge 30. The scorotron type charger 34 charges the surface of the photosensitive drum 33. The toner box 35 is provided at a location above the photosensitive drum 33. The supply roller 31 and the developer roller 32 are provided at locations below the toner box 35. Toner is supplied to the surface of the photosensitive drum 33 by the operation of the supply roller 31 and the developer roller 32. An electrostatic latent image is formed by the laser beam L from the scanner unit 20 on the surface of the photosensitive drum 33, and the electrostatic latent image is then developed by the supply of toner by the developer roller 32 to the surface of the photosensitive drum 33. The photosensitive drum 33 faces the transfer roller 39 with the conveyor belt 38 sandwiched therebetween. The transfer bias voltage is applied to the transfer roller 39. Accordingly, toner that has developed the electrostatic latent image on the photosensitive drum 33 is transferred to the recording paper P that is conveyed on the conveyor belt 38. This causes the formation of color images in magenta, yellow, cyan, and black in sequence on the recording paper P. The recording paper P that has passed below each image-forming portion 17 will then be supplied to the fixing section 19. The recording paper P, on which the image is fixed by the fixing portion 19, is then conveyed by the pair of sheet-discharge rollers 51 and is sent out onto the sheet-discharge tray 52 at the top of the main casing 2.

Figure 2:
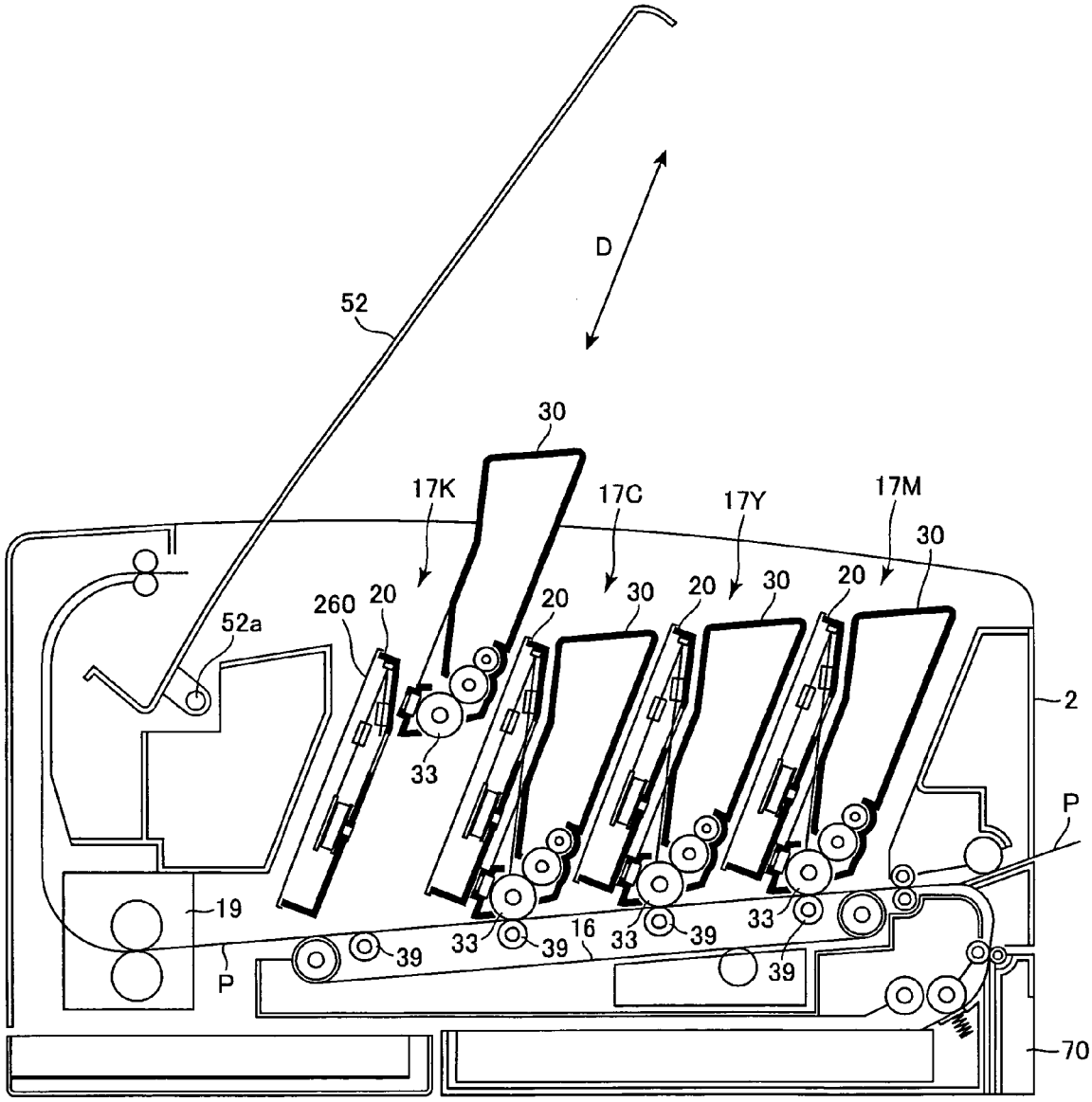
FIG. 2 illustrates how to exchange a process cartridge in the color laser printer of FIG. 1.

As shown in FIG. 2, in each image forming portion 17, the process cartridge 30 is inserted or removed along a direction D that is inclined in both the horizontal direction (front-to-rear direction) and the vertical direction (the thickness direction of the paper P), in other words, in a direction that is inclined forwardly upwardly. Thus the ease of operation of inserting or removing the process cartridge 30 can be improved.

Furthermore, the plurality of the process cartridges 30 and the corresponding plurality of the scanner units 20 are disposed alternately in the front-to-rear direction in the color laser printer 1. This efficient disposition can make the device more compact.

More specifically, the scanner units 20 and the process cartridges 30 are disposed alternately in the direction in which a sheet of paper P is conveyed by the conveyor belt 38 below the scanner units 20 and the process cartridges 30 at image transfer positions. Accordingly, the scanner units 20 and the process cartridges 30 can be arranged efficiently in the color laser printer 1, and the color laser printer 1 can be made compact.

The scanner units 20 and the process cartridges 30 are inclined so that the upper ends thereof face upwardly forwardly. This can suppress the height of the device, making it compact than a comparative example, where the scanner units 20 and the process cartridges 30 are not inclined but are erected vertically.

It is noted that although the scanner units 20 and the process cartridges 30 are disposed at an angle in the color laser printer 1, the depthwise dimension (front-to-rear dimension) of the color laser printer 1 is not greatly increased relative to the comparative example. This is because the sheet supply cassette 70 is inserted and removed in the depthwise direction, and because the depthwise dimension of the comparative printer is greater than a total of the depthwise sizes of all the vertically-erected scanner units 20 and process cartridges 30 by a length of a space, which is provided next to the scanner units 20 and the process cartridges 30 in the depthwise direction in the main casing 2 to receive other components such as various rollers mounted therein.

In addition, each process cartridge 30 is inserted or removed in a direction that is inclined towards the front (in the direction denoted by the arrow D in FIG. 2) in a direction parallel to the front inner side wall 2*a* and the rear inner side wall 2*b*.

In other words, each process cartridge 30 is inserted or removed along a direction that is inclined with respect to the direction in which a sheet of paper P is conveyed below the subject process cartridge 30 at its image transfer position and the direction of thickness of the sheet of paper P that is orthogonal to the conveying direction. Insertion or removal of the process cartridge 30 is facilitated.

Moreover, this embodiment ensures that the operation of this device is greatly improved, because the operations of replenishing the recording paper P in the sheet supply cassette 70 and removing the recording paper P from the sheet discharge tray 52 are done from the front, in a similar manner to the insertion or removal of each process cartridge 30.

With this embodiment, the conveyor belt 38 is disposed at an inclination so that it is higher at the front than the rear. In other words, the conveyor belt 38 descends downward on the downstream side in the toner transfer direction. For that reason, a wide space is formed below the front side of the conveyor belt 38, enabling the components such as the paper supply rollers 10 and 11 to be mounted below the front side of the conveyor belt 38.

Because the conveyor belt 38 is inclined, it is possible to reduce the depthwise dimension of the device. The entire device can be made even more compact.

The direction, in which the conveyor belt 38 is inclined, and the direction, in which the process cartridges 30 are inclined, form a space on the downstream side of each photosensitive drum 33 in its rotating direction. This enables the comparatively large scorotron charger 34 to be disposed in the downstream side of each photosensitive drum 33 in its rotating direction, without increasing the size of the device 1.

In addition, the device 1 can be made even more compact by ensuring that the height of the scanner units 20 matches the height of the process cartridges 30.

More specifically, a line connecting the upper ends of the scanner units 20 and the process cartridges 30 extend at a predetermined angle with respect to the horizontal direction to be inclined upwardly forwardly. The line connecting the upper end surfaces of the scanner units 20 and the upper end surfaces of process cartridges 30 is parallel to the direction of inclination of the conveyor belt 38. The device 1 can therefore be made even more compact.

The sheet-discharge tray 52 is disposed along the upper ends of the scanner units 20 and process cartridges 30. The sheet discharge tray 52 extends substantially parallel to the direction of inclination of the conveyor belt 38. Accordingly, a fixed-width airflow is created on the under side of the tray 52, that is, between the sheet discharge tray 52 and the scanner units 20 and the process cartridges 30. For that reason, the device 1 can be made suitably compact, while ensuring ventilation in the vicinity of the upper ends of the process cartridges 30. This enables favorable disposal of heat.

The fold-back mirror 23 is located in the vicinity of the top of each scanner unit 20. The photosensitive drum 33 is in the vicinity of the lower end of the process cartridge 30. Accordingly, the laser light travels from the vicinity of the upper end of the scanner unit 20 to the vicinity of the lower end of the process cartridge 30, before performing exposure scan of the photosensitive drum 33. Accordingly, the long length of the optical path for the exposure can be maintained and the scanner unit 20 can be made compact by reducing the size of the lenses mounted therein.

In addition, since the exposure scan is performed from a position at a distance from the photosensitive drum 33, contamination of the optical components mounted in the scanner unit 20 by toner can be prevented. The device can therefore be made even more compact and an even clear image can be formed.

The upper end of the scanner housing 26 is made narrower in the rearward direction. The upper end of each toner box 35 is expanded by an equivalent amount in the rearward direction to protrude toward the narrowed upper end of the scanner housing 26.

More specifically, each scanner housing 26 has: an upper portion that extends from the upper end 26U to the middle of the scanner housing 26; and a lower portion that extends from the middle to the lower end 26D of the scanner housing 26. Each process cartridge 30 has: an upper part that extends from the upper end 30U to the middle of the process cartridge 30; and a lower part that extends from the middle to the lower end 30D of the process cartridge 30. In the lower parts, the scanner housing 26 has a uniform depth (width in the front-to-rear direction) from the lower end 26D to the middle. Similarly, in the lower part of the process cartridge 30, the process cartridge 30 has a uniform depth (width in the front-to-rear direction) from the lower end 30D to the middle. Contrarily, the upper part of each scanner housing 26 has a depth (width in the front-to-rear direction) that decreases toward the upper end 26U from the middle by narrowing in the rearward direction toward the upper end 26U. The upper part of each process cartridge 30 has a depth (width in the front-to-rear direction) that increases toward the upper end 30U from the middle by protruding in the rearward direction toward the upper end.

In this way, the depth of each scanner unit 20 (width of each scanner unit 20 in the direction in which the scanner units 20 are disposed alternately with the process cartridges 30) is narrower in the vicinity of the upper end of the scanner unit 20, and the depth of each process cartridge 30 (width of each process cartridge 30 in the same direction) becomes wider in the vicinity of the upper end of the process cartridge 30, to match or complement the narrow portion of the scanner unit 20. Accordingly, the total of the depth of the scanner unit 20 and the depth of the process unit 31 is substantially uniform from the lower ends to their upper ends.

Accordingly, the amount of toner that can be stored in the toner box 35 can be increased without making the device 1 any larger, reducing the frequency of exchange thereof and thus further improving the maintainability. The color laser printer 1 can therefore be made a suitably compact device and also the maintainability thereof can be improved.

In the color laser printer 1, the paper P is directed forward by the pickup roller 10 in the paper supply section 4, the paper P is conveyed rearward at the image transfer positions, and the paper P is delivered forward by the sheet discharge rollers 51 in the sheet discharging section 6. The device can thus be made compact, while ensuring the conveying path of the paper P.

As described above, according to the present embodiment, the color laser printer 1 has the scanner units 20 and the process cartridges 30, which are disposed alternately in the front-to-rear direction and at an angle with the upper ends thereof inclined forward. Because the scanner units 20 and the process cartridges 30 are inclined obliquely, the height of the device 1 can be decreased and the device 1 can be made compact, in comparison with a comparative example where the process cartridges 30 were erected vertically above the conveyor belt 38.

Since each process cartridge 30 can be inserted and removed in a direction that is obliquely inclined with respect to the forward direction, the insertion and removal of the process cartridge 30 is facilitated, in comparison with the comparative example where the process cartridge 30 were erected vertically and therefore had to be pulled out in the vertical direction.

In addition, the conveyor belt 38 is disposed at an angle such that the front end thereof is higher than the rear end thereof, so that the device 1 can be made even more compact.

Modification of Sheet Discharge Tray

Figure 3:
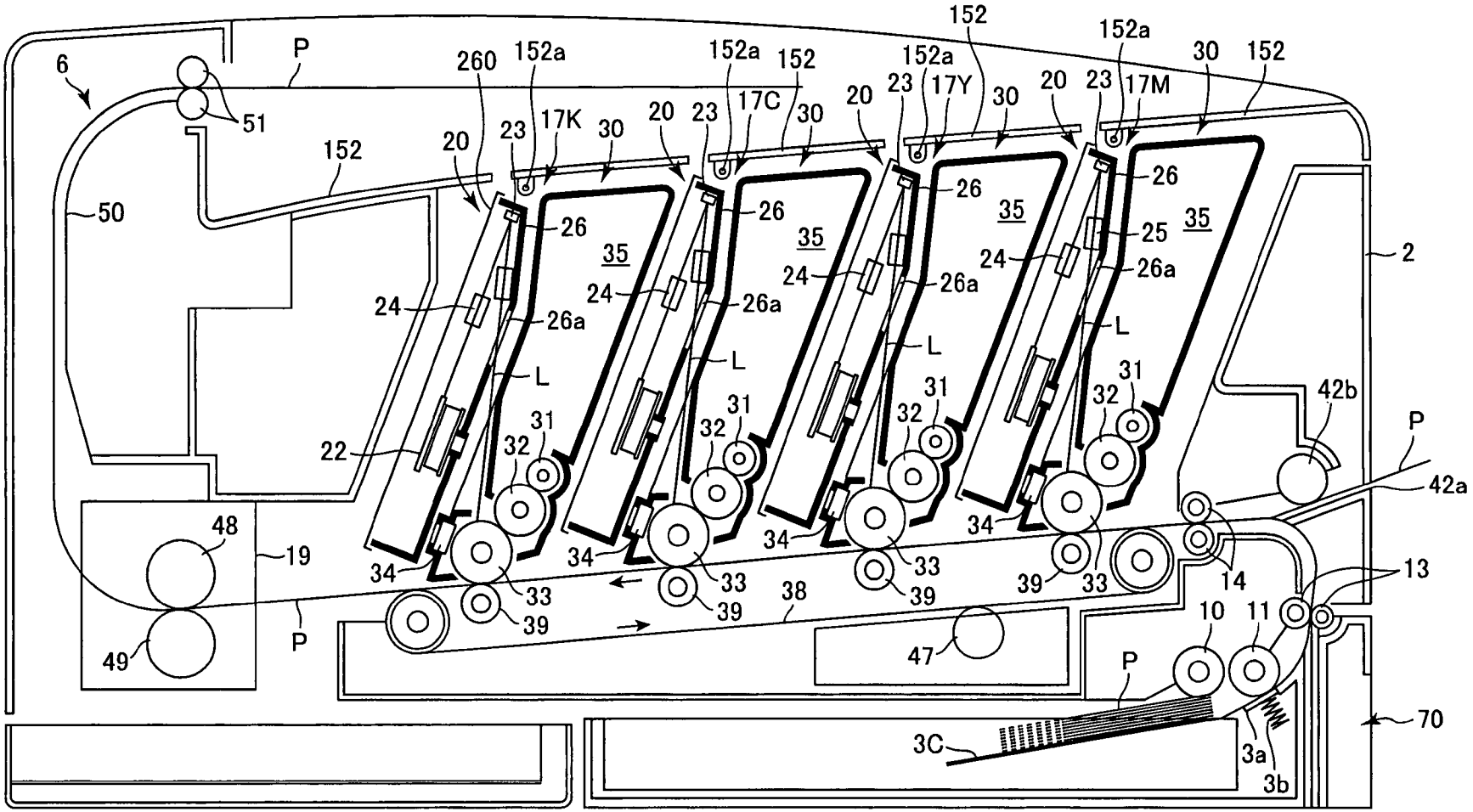
FIG. 3 is a side sectional view of the overall configuration showing a modification of a sheet discharge tray of FIG. 1.

In the above description, the sheet discharge tray 52 is provided to cover all of the image-forming portions 17M to 17K. Instead, as shown in FIG. 3, a plurality of sheet discharge trays 152 may be provided covering the image-forming portions 17M to 17K separately. Each sheet discharge tray 152 can be opened and closed independently about its hinge 152*a*.

In this modification, only one sheet discharge tray 152, which corresponds to a process cartridge 30 that requires maintenance, need be opened and closed. The operation can be simplified.

Details of Scanner Unit

The configuration of the scanner support frames 260 and the scanner unit 20 will now be described in more detail with reference to FIG. 4-FIG. 8.

Figure 4:
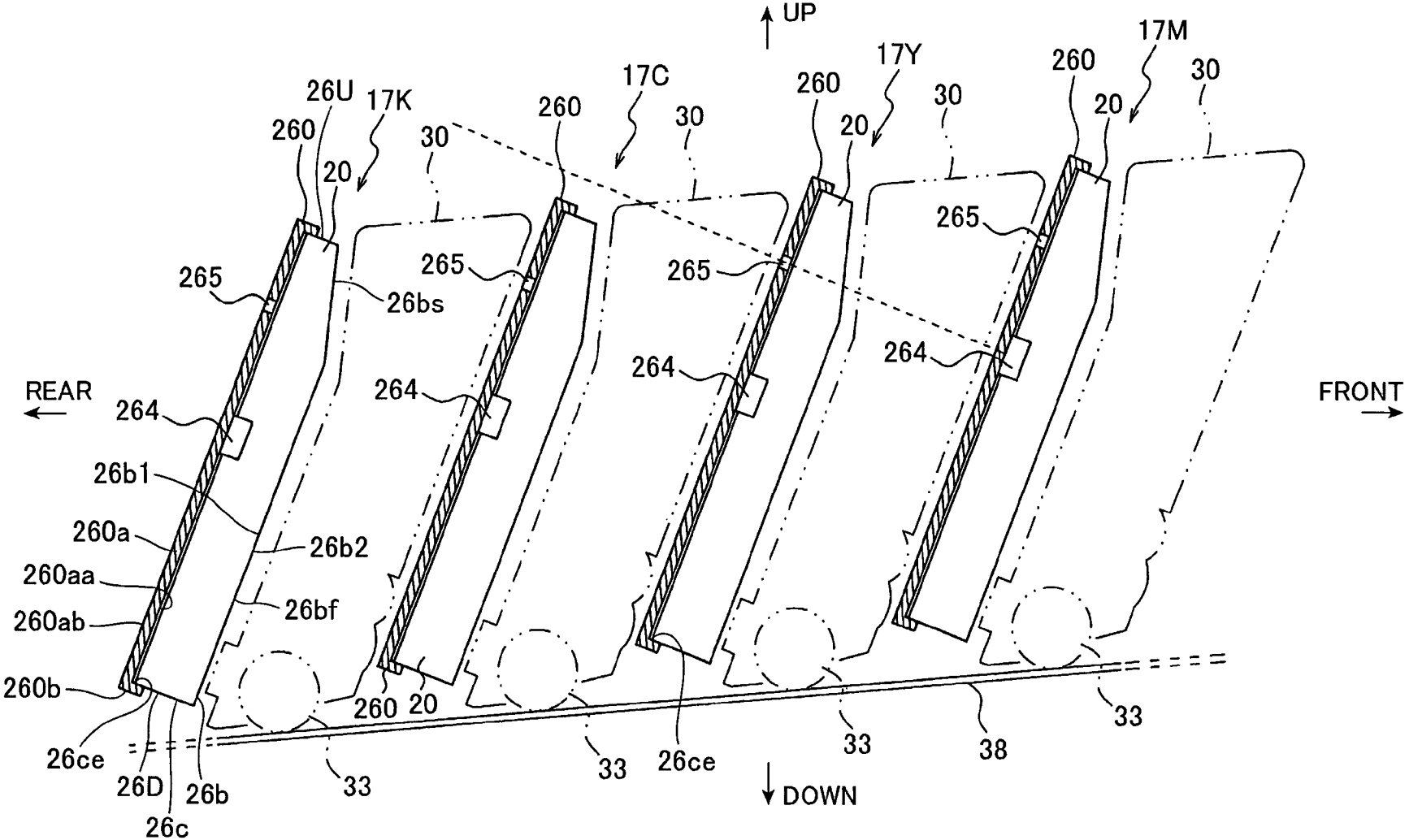
FIG. 4 illustrates the state of the image forming section, from which process cartridges are removed to adjust the orientation of the scanner units by using a screwdriver.

As shown in FIG. 4, the four support frames 260 corresponding to the colors of magenta, yellow, cyan, and black are fixedly mounted in the main casing 2 in parallel with the front and rear inner side walls 2*a* and 2*b* (FIG. 1). The scanner unit 20 is mounted on each support frame 260.

Figure 5:
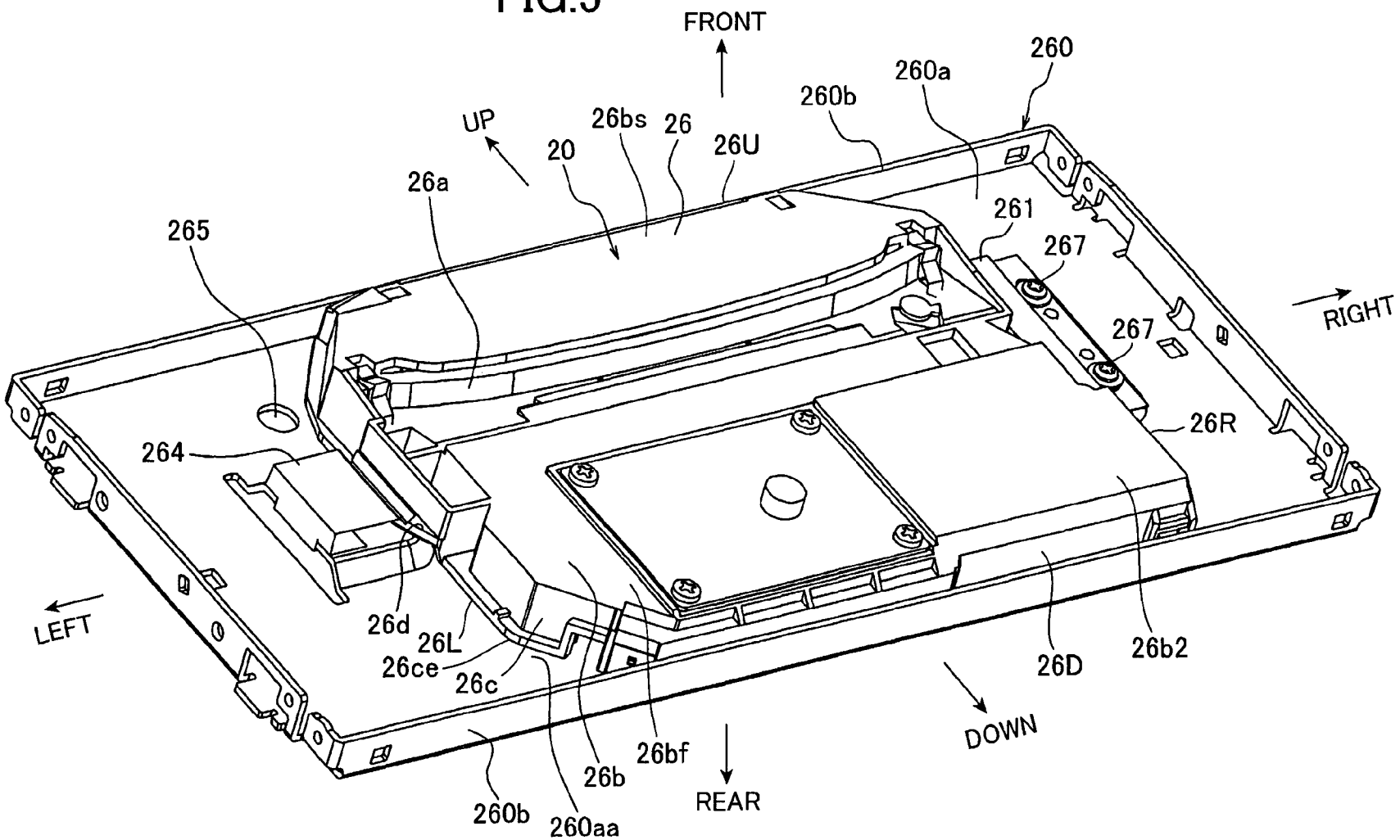
FIG. 5 is a perspective view of the scanner unit mounted on a scanner support frame.

As shown in FIG. 5, the support frame 260 has a substantially rectangular base plate 260*a*. The base plate 260*a* has an inner surface 260*aa* and an outer surface 260*ab* opposite to each other. The support frame 260 further has a side wall 260*b* provided around the periphery of the base plate 260*a*. The side wall 260*b* is erected perpendicularly from the inner surface 260*aa* of the base plate 260*a* as surrounding the inner surface 260*aa*. The support frame 260 is fixedly mounted in the main casing 2, with the base plate 260*a* being inclined to extend forwardly upwardly, with the inner surface 260*aa* facing forwardly downwardly.

Figure 6:
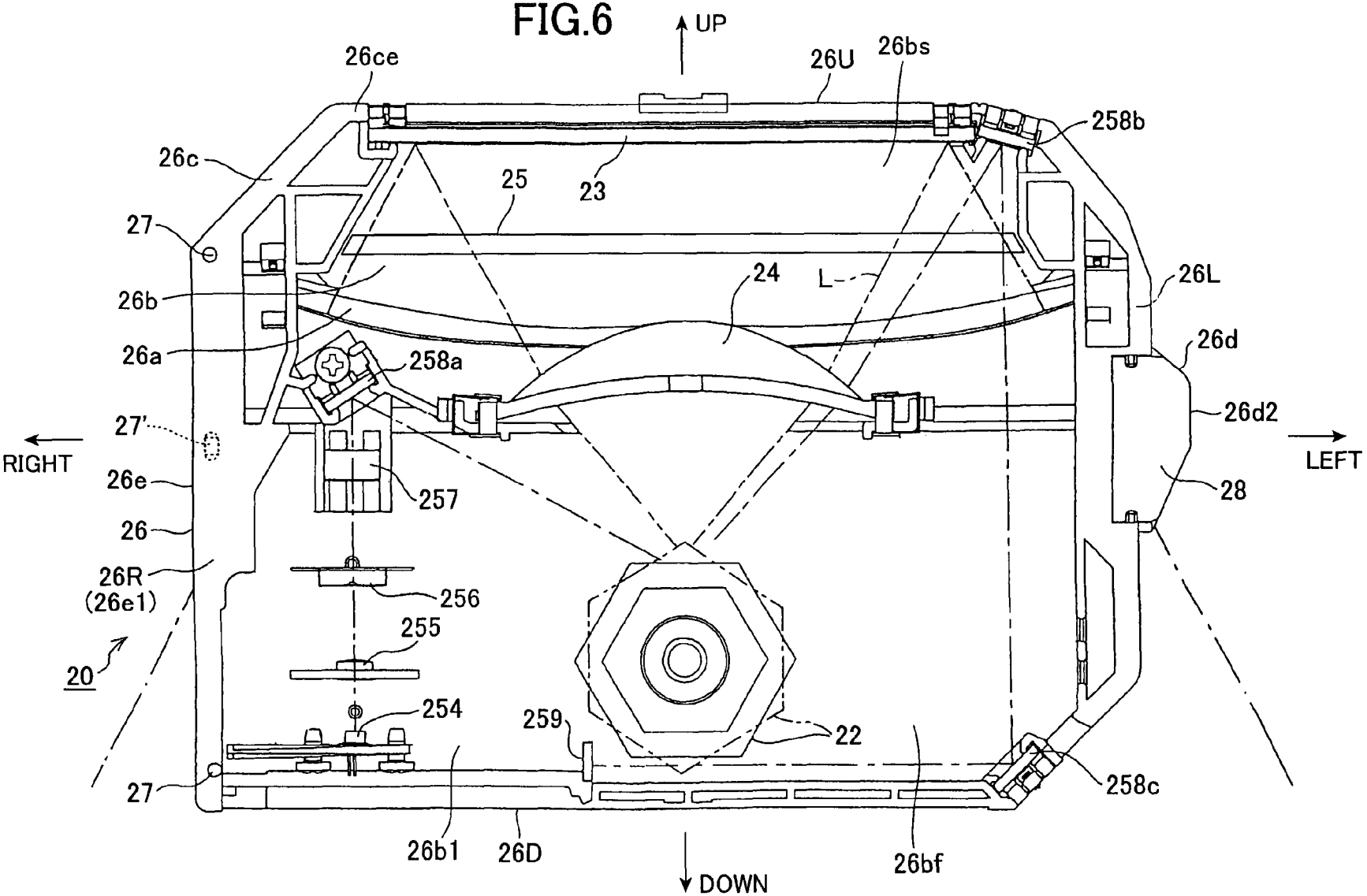
FIG. 6 is a plan view showing the inside of the scanner unit seen from a scanner support frame side.

As shown in FIGS. 4 to 6, the scanner housing 26 of the scanner unit 20 has a base plate 26*b* formed with the exposure aperture 26*a*. The base plate 26*b* has a flat portion 26*bf* and a slanted portion 26*bs*. The flat portion 26*bf* extends from the lower edge 26D of the scanner housing 26 to the middle portion of the scanner housing 26, while the slanted portion 26*bs* extends from the middle portion to the upper edge 26U of the scanner housing 26. The slanted portion 26*bs* is slanted with respect to the flat portion 26*bf*. The base plate 26*b* has an inner surface 26*b*1 and an outer surface 26*b*2 opposite to each other. The scanner housing 26 further has a side wall 26*c* provided around the periphery of the base plate 26*b*. The side wall 26*c* is erected perpendicularly from the inner surface 26*b*1 as surrounding the inner surface 26*b*1. The side wall 26*c* has a tip end surface 26*ce*. As shown in FIG. 4, the height of a portion of the side wall 26*c* that is erected from the flat portion 26*bf* of the base plate 26*b* is substantially uniform over the entire flat portion 26*bf*, while the height of a remaining portion of the side wall 26*c* that is erected from the slanted portion 26*bs* of the base plate 26*b* decreases toward the upper end 26U.

The scanner unit 20 is mounted on the support frame 260, with the inner surface 26*b*1 of the base plate 26*b* and the tip end surface 26*ce* of the side wall 26*c* confronting the inner surface 260*aa* of the support frame 260. It is noted that a right end 26R and a left end 26L of the scanner unit 20 face rightwardly and leftwardly in the main casing 2. The upper end 26U and the lower end 26D of the scanner unit 20 face upwardly and downwardly in the main casing 2.

As shown in FIG. 6, the polygon mirror 22, the fθ lens 24, and the cylindrical lens 25 are mounted on the inner surface 26*b*1 of the base plate 26*b*. In addition, a collimator lens 255, a slit device 256, a cylindrical lens 257, reflective mirrors 258*a*, 258*b*, and 258*c*, and a BD sensor 259 are mounted on the inner surface 26*b*1 of the base plate 26*b*. A laser diode 254 is attached to the side wall 26*c* on the lower edge 26D of the scanner housing 26. The fold-back mirror 23 is attached to the side wall 26*c* on the upper edge 26U of the scanner housing 26.

The laser diode 254 emits a laser beam L. After passing through the collimator lens 255, the slit device 256, and the cylindrical lens 257, the laser beam L reflects off the reflective mirror 258*a*, before reaching the polygon mirror 22. The polygon mirror 22 deflects the laser beam L in the scanning direction, that is, the left-to-right direction. The laser beam L passes through the fθ lens 24, before reaching the fold-back mirror 23. The laser beam L reflects off the fold-back mirror 23 to travel through the cylindrical lens 25 to the aperture 26*a*. After passing through the aperture 26*a*, the laser beam L reaches the photosensitive drum 33.

The positions of the polygon mirror 22, the fθ lens 24, the fold-back mirror 23, the cylindrical lens 25, and the exposure aperture 26*a* and the orientation of the mirror surface of the fold-back mirror 23 are set so that the optical path extending from the fold-back mirror 23 through the cylindrical lens 25 to the exposure aperture 26*a* is angularly shifted from the optical path extending from the polygon mirror 22 through the fθ lens 24 to the fold-back mirror 23 by the amount α (15 degrees in this example) along an imaginary plane that is perpendicularly to the scanning direction.

While the laser beam L is being scanned by the polygon mirror 22, the laser beam L from the fθ lens 24 reaches the fold-back mirror 23 or the reflective mirror 258*b*, which is disposed adjacent to the fold-back mirror 23. When the laser beam L reaches the reflective mirror 258*b*, the laser beam L reflects off the reflective mirror 258*b* and reflects off the reflective mirror 258*c*, before falling incident on the BD sensor 259.

The rotational period and the rotational timing of the polygon mirror 22 are set to ensure that while the laser beam L falls incident on the reflective mirror 258*b*, the angular edges of the polygon mirror 22 will not be in the optical path of the laser beam L between the reflective mirror 258*c* and the BD sensor 259 as indicated by a solid line in FIG. 6.

The laser diode 254 is controlled to turn on and off at a timing that is synchronized with the rotation of the polygon mirror 22 in accordance with image data. The position at which an image is started being written on the photosensitive drum 33 in the scan direction is made suitably fixed by controlling this on/off timing dependently on the timing at which the laser beam L falls incident on the BD sensor 259.

Next will be described how to mount the scanner unit 20 on the support frame 260, which is affixed to the main casing 2.

Figure 7A:
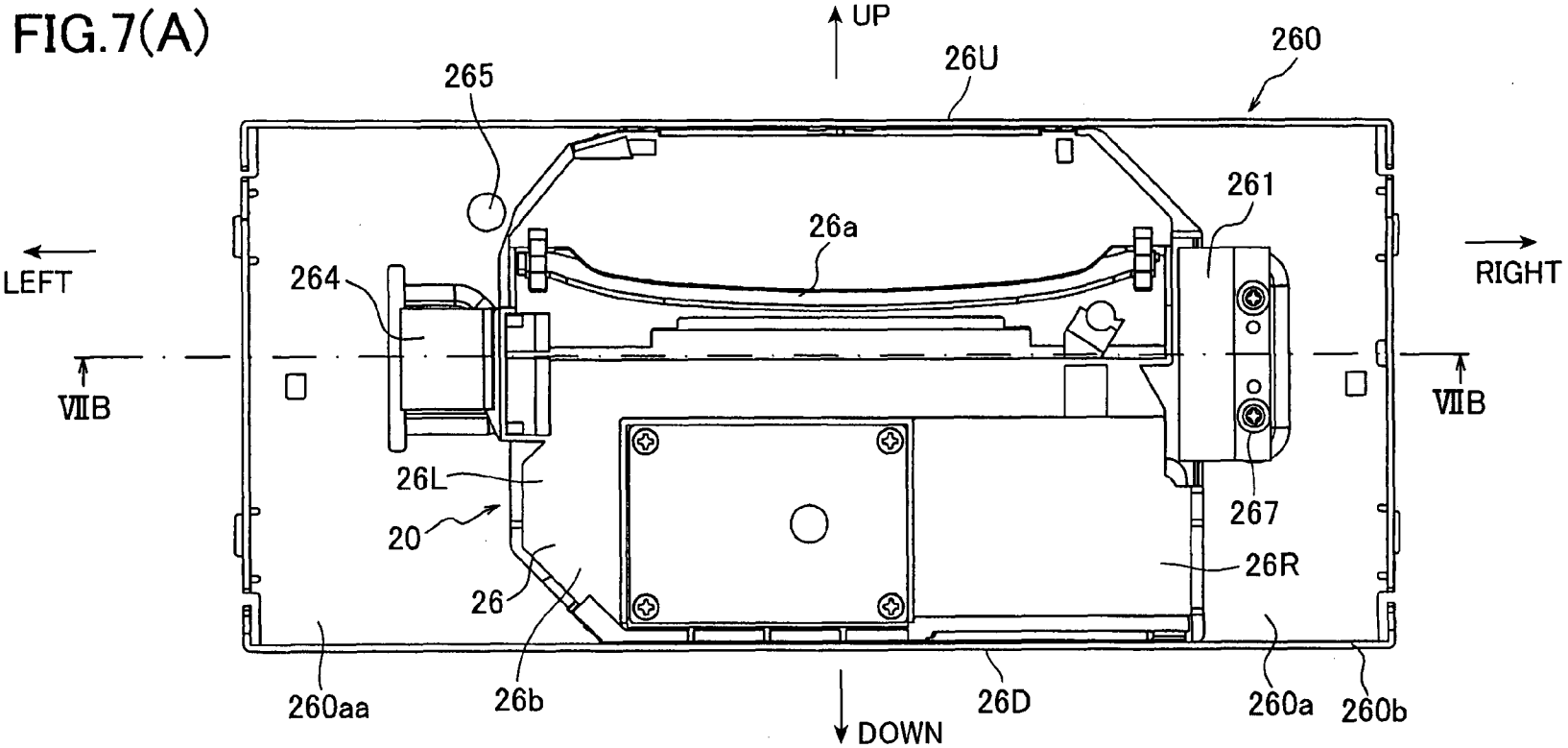
FIG. 7(A) is a plan view showing the outside of the scanner unit fixed to the scanner support frame shown in FIG. 5.
Figure 7B:
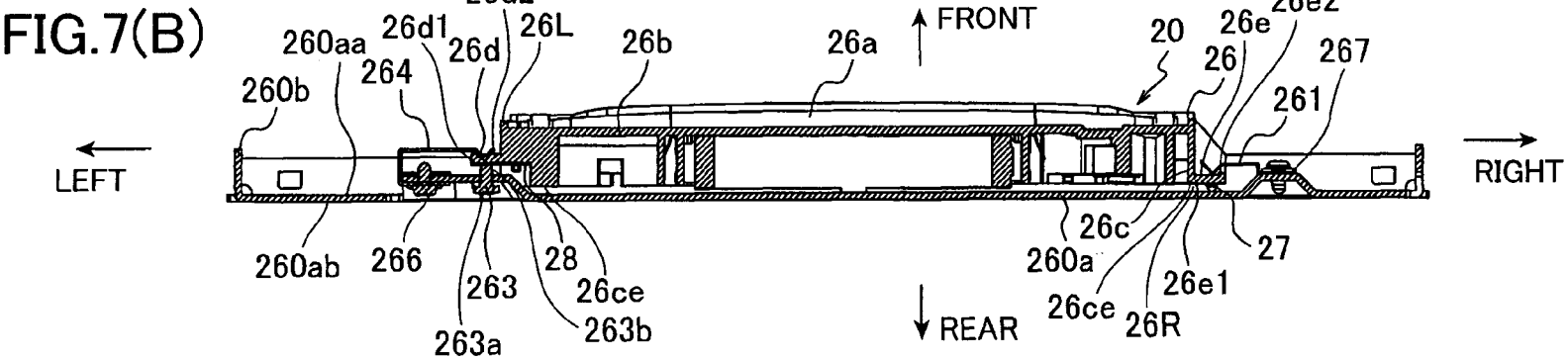
FIG. 7(B) is a sectional side view of the scanner unit fixed to the scanner support frame, taken along a line VIIB-VIIB in FIG. 7(A)

As shown in FIGS. 6 and 7(B), the scanner housing 26 has a right side extension 26*e* which extends rightwardly from the side wall 26*c* at the right end 26R and which is thinner than the side wall 26*c*. The right side extension 26*e* has: a surface 26*e*1 that confronts the inner surface 260*aa* of the base plate 260*a* of the scanner support frame 260; and another surface 26*e*2 opposite to the surface 26*e*1. The surface 26*e*1 is continuous with the tip end surface 26*ce* of the side wall 26*c*.

A pair of protrusions 27 are formed on the surface 26*e*1 of the right side extension 26*e*. The pair of protrusions 27 are arranged along a line that extends orthogonal to the scan direction (right-to-left direction).

Figure 8:
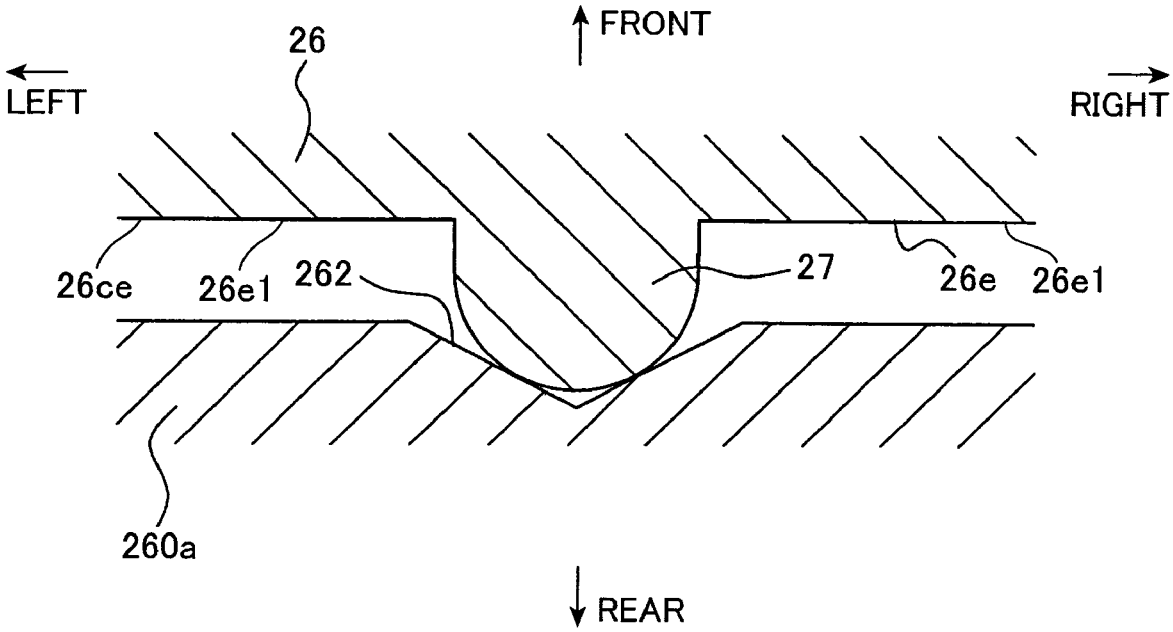
FIG. 8 is an enlarged sectional side view illustrating how a protrusion of the scanner unit is disposed on a depression of the scanner support frame.

As shown in FIG. 8, each protrusion 27 has a substantially semicircular shape in its cross-section along an imaginary plane that extends parallel to the scanning direction (left-and-right direction) and perpendicularly to the surfaces 26*e*1 and 26*e*2.

A leaf spring 261 is fixed at its one end by a screw 267 onto the inner surface 260*aa* of the scanner support frame 260. The other end of the leaf spring 261 presses the surface 26*e*2 of the right side extension 26*e* in a direction toward the base plate 260*a*. Thus, the pair of protrusions 27 are pressed by the leaf spring 261 against the base plate 260*a*.

A pair of depressions 262 are formed on the inner surface 260*aa* of the base plate 260*a*. Each depression 262 is located at a position facing the corresponding protrusion 27 as shown in FIG. 8. The depression 262 has a V-shape in its cross-section along the imaginary plane that extends parallel to the scanning direction (left-and-right direction) and perpendicularly to the inner surface 260*aa*.

The protrusion 27 is disposed in the center of the depression 262 by the urging force of the leaf spring 261. The depth of the depression 262 is sufficiently small that the tip end surface 26*ce* of the side wall 26*c* and the surface 26*e*1 of the right side extension 26*e* does not come into contact with the inner surface 260*aa* of the base plate 260*a* when the protrusions 27 are disposed at the centers of the depressions 262.

As shown in FIG. 6-FIG. 7(B), a flange portion 26*d* protrudes leftwardly from the side wall 26*c* at the left side end 26L of the scanner housing 26. The flange portion 26*d* has: a surface 26*d*1 that confronts the inner surface 260*aa* of the base plate 260*a*; and another surface 26*d*2 opposite to the surface 26*e*1. A steel plate 28 is fixedly secured to the surface 26*d*1 of the flange portion 26*d*.

A screw 263 passes through the base plate 260*a*, with its screw head 263*a* being on the outer surface 260*ab* side and its tip end 263*b* being on the inner surface 260*aa* side. Thus, the screw 263 is engaged with the base plate 260*a*.

A leaf spring 264 is provided in the vicinity of the screw 263. That is, the leaf spring 264 is fixed at its one end by a screw 266 onto the outer surface 260*ab* of the scanner support frame 260. The other end of the leaf spring 264 presses the surface 26*d*2 of the flange portion 26*d* in a direction toward the base plate 260*a*. Thus, the leaf spring 264 presses the flange portion 26*d* in a direction toward the base plate 260*a* to bring the tip end 263*b* of the screw 263 into contact with the steel plate 28.

With the above-described configuration, when the amount of engagement of the screw 263 is adjusted to change the distance between the base plate 260*a* and the flange portion 26*d*, the scanner unit 20 swings about the contacts between the protrusions 27 and the depressions 262. Accordingly, it is possible to adjust the orientation of the scanner unit 20 with respect to the support frame 260 in the right-to-left direction.

When the adjustment of engagement amount of the screw 263 is completed, the scanner unit 20 is fixedly secured to the support frame 260 in the adjusted orientation as being supported by three points (the screw 263 and the pair of protrusions 27).

The scanner unit 20 has a relatively long, flat configuration in the right-to-left direction in which the light beam is scanned. The two end portions 26R and 26L of the scanner unit 20 in the longitudinal direction thereof are supported by the combination of the protrusions 27 and the depressions 262 and the combination of the screw 263 and the leaf spring 264, respectively. Since the distance between the scanner unit 20 and the support frame 260 at the left end 26L is determined by the adjustment of the screw 263, the assembly of the scanner unit 20 and the support frame 260 is extremely stable after the adjustment of the distance. It requires no further fixing operation after completing the adjustment of the distance.

As shown in FIG. 5 and FIG. 7(A), a through-hole 265 is formed through the base plate 260*a* at a location near the leaf spring 264. The through-hole 265 facilitates the adjustment of the amount of engagement of the screw 263.

More specifically, as shown in FIG. 4, the adjustment of the orientation of each scanner unit 20 can be performed when the process cartridges 30 are removed from the main casing 2 and a sensor such as a CCD is disposed on the conveyor belt 38.

The orientation of each scanner unit 20 can be adjusted by inserting a screwdriver into the through-hole 265, as indicated by the broken line in FIG. 4, even when the plurality of scanner units 20 are mounted in the main casing 2.

In this example, only the through-hole 265 used for adjusting the amount of engagement of the screw 263 is provided in the scanner support frame 260. However, another through-hole 265 can additionally be formed through the scanner support frame 260, to enable adjustment of the amount of engagement of the screw 266 that fixes the leaf spring 264.

Thus, according to the present embodiment, the scanner support frames 260 are provided in parallel in the plurality of stages in the main casing 2. The optical scanner units 20 each having the scanner housing 26 are mounted on the scanner support frames 260. The through-hole 265 is formed in each support frame 260 for allowing insertion of a screwdriver to perform adjustment of the amount of engagement of the screw 263 in another scanner unit 20 that is next to the subject scanner unit 20 in the forward direction.

It is noted that because the color laser printer 1 is of a tandem type, the plurality of scanner units 20 are provided in parallel with one another in the plurality of stages. In this type of device, it is necessary to adjust the orientation of each scanner unit 20. According to the present embodiment, the adjustment of the orientation of each scanner unit 20 can be performed by adjusting the amount of engagement of the screw 263.

In addition, the through-hole 265 is formed in the support frame 260 in each stage for the insertion of a screwdriver to enable the adjustment of the amount of engagement of the screw 263 in the adjacent scanner unit 20. The orientation of the scanner housing 26 in each scanner unit 20 can be adjusted, without removing other scanner units 20 mounted in the main casing 2. The orientation of each scanner unit 20 can therefore be adjusted in an extremely simple manner without interfering with the other scanner units 20, even though the scanner units 20 are provided in a plurality of parallel stages.

As described above, according to the present embodiment, the leaf spring 261 presses the protrusions 27 formed on the surface **26*e*1 of the right side extension 26*e* from the opposite side 26*e*2 in the direction toward the base plate 260*a* of the support frame 260, whereby the protrusion 27 is bought into contact with the depression 262 formed on the base plate 260*a*. The screw 263 passes through the base plate 260*a* from the outer surface 260*ab* to the inner surface 260*aa* to have its tip end 263*b* facing the flange portion 26*d* of the scanner unit 20. Thus, the screw 263 is engaged with the base plate 260*a*. The leaf spring 264 is fixedly mounted on the base plate 260*a* in the vicinity of the screw 263 to press the flange portion 26*d* in a direction toward the base plate 260*a*. The orientation of the scanner unit 20 with respect to the support frame 260 can be adjusted by adjusting the amount of engagement of the screw 263. Accordingly, it is possible to improve the ease of operation of affixing the scanner unit 20 to the support frame 260**.

By bringing the protrusions 27 and the depressions 262 into contact with each other, the combination of the protrusions 27 and the depressions 262 regulates the position of the scanner housing 26 relative to the scanner support frame 260 so that a spacing of some amount is maintained between the scanner housing 26 and the scanner support frame 260. The scanner housing 26 is therefore maintained with a gap being formed between the scanner housing 26 and the support frame 260.

Thus the orientation of the scanner housing 26 can be adjusted in a simple manner, while the spacing between the scanner housing 26 and the support frame 260 is maintained, by pivoting the scanner housing 26 about the contact portions between the protrusions 27 and the depressions 262. In this case, adjustment of the screw 263 pivots the scanner housing 26 about the contact portions to adjust the orientation of the scanner housing 26. Even with the simple configuration of the protrusions 27 and the depressions 262, the position of the pivot center does not shift and thus the orientation of the scanner housing 26 can be adjusted in a simple manner. Moreover, the scanner housing 26 can be supported on the support frame 260 even more stably after the adjustment.

As described above, the orientation of each scanner unit 20 in the color laser printer 1 can be adjusted in a simple manner by just adjusting the amount of engagement of the screw 263, and there is no shifting of the positions of the scanner units 20 after the adjustment. It is therefore possible to facilitate the operation of fixing the scanner units 20 to the support frames 260, enabling an improvement in the ease of operation.

The flange **26*d* at the left end 26L of the scanner housing 26 is sandwiched between the leaf spring 264 and the screw 263. Accordingly, the flange 26*d* can be fixed firmly to the scanner support frame 260 at the same time as the adjustment of the screw 263 regardless of this simple configuration. The scanner unit 20 can therefore be supported stably on the support frame 260** after the adjustment.

Since the plurality of protrusions 27 are arranged along a straight line in the direction orthogonal to the scan direction of the laser beam L in each scanner unit 20, rotation of the scanner unit 20 about the center of an axis parallel to the scan direction can be prevented. This makes the adjustment of the orientation of the scanner units 20 simple.

The fold-back mirror 23 reflects the laser beam L in such a manner that the angle formed between the laser beam L before the reflection and the laser beam L after the reflection is approximately 15° along the imaginary sectional plane that is orthogonal to the scan direction. By adjusting the amount of engagement of the screw 263 to adjust the orientation of the scanner unit 20 along the scanning direction, it is possible to adjust the scan direction (that is, the direction of scan lines formed on the photosensitive drum 33) to be parallel with the rotational shaft of the photosensitive drum 33. The accuracy of image formation can therefore be improved.

It is noted that the angle $\alpha$ formed, on the imaginary sectional plane that is orthogonal to the scan direction, between a light beam before being reflected by the fold-back mirror 23 and a light beam after being reflected back by the fold-back mirror 23 may not be equal to 15 degrees. It is preferable that the angle $\alpha$ satisfies the inequality of $0° < \alpha < 45°$. In this case, the degree of parallelism between the axis of the photosensitive drum 33 and the scan direction, which has the most effect on the quality of the image, can be guaranteed by adjusting the orientation of the scanner unit 20 about an axis that is orthogonal to the scan direction. The quality of an image formed after adjustment can be improved.

It is noted that as indicated by a broken line in FIG. 6, another protrusion 27' can be additionally provided on the surface **26*e*1 of the right side extension 26*e*. The additional protrusion 27' is located on the same line with the protrusions 27 in the direction orthogonal to the scan direction of the laser beam L. The additional protrusion 27' extends continuously on the line, on which the protrusions 27 are arranged. The additional protrusion 27' has the cross-section with the same shape and the same size as those of the protrusions 27 shown in FIG. 8**.

In this case, although not shown in the drawings, another depression is additionally formed on the inner surface 260*aa* of the base plate 260*a* of the support frame 260. The additional depression is located on the same line with the depressions 262 in the direction orthogonal to the scan direction of the laser beam L. The additional depression is located at a position confronting the additional protrusion 27', and extends continuously with the same length as the additional protrusion 27' on the line, on which the depressions 262 are arranged. The additional depression has the cross-section with the same shape and the same size as those of the depressions 262 shown in FIG. 8. By adjusting the engagement amount of the screw 263, it is possible to pivot the scanner unit 20 about the contact positions between the protrusions 27 and the depressions 262 and between the additional protrusion 27' and the additional depression.

It is noted that the protrusions 27 may be omitted from the scanner housing 26 and the depressions 262 may be omitted from the scanner support frame 260 when the additional elongated protrusion 27' is provided on the scanner housing 26 and the additional elongated depression is provided on the scanner support frame 260. In this case, the scanner housing 26 is supported on the scanner support frame 270 at two points, that is, the contact portion between the additional elongated protrusion 27' and the additional elongated depression and the contact portion between the flange 26*d* and the screw 263.

Alternatively, the protrusions 27 and/or the additional elongated protrusions 27' may be provided on the support frame 260, while the depressions 262 and/or the additional elongated depressions may be provided on the scanner housing 26.

Modification of First Embodiment

Figure 9:
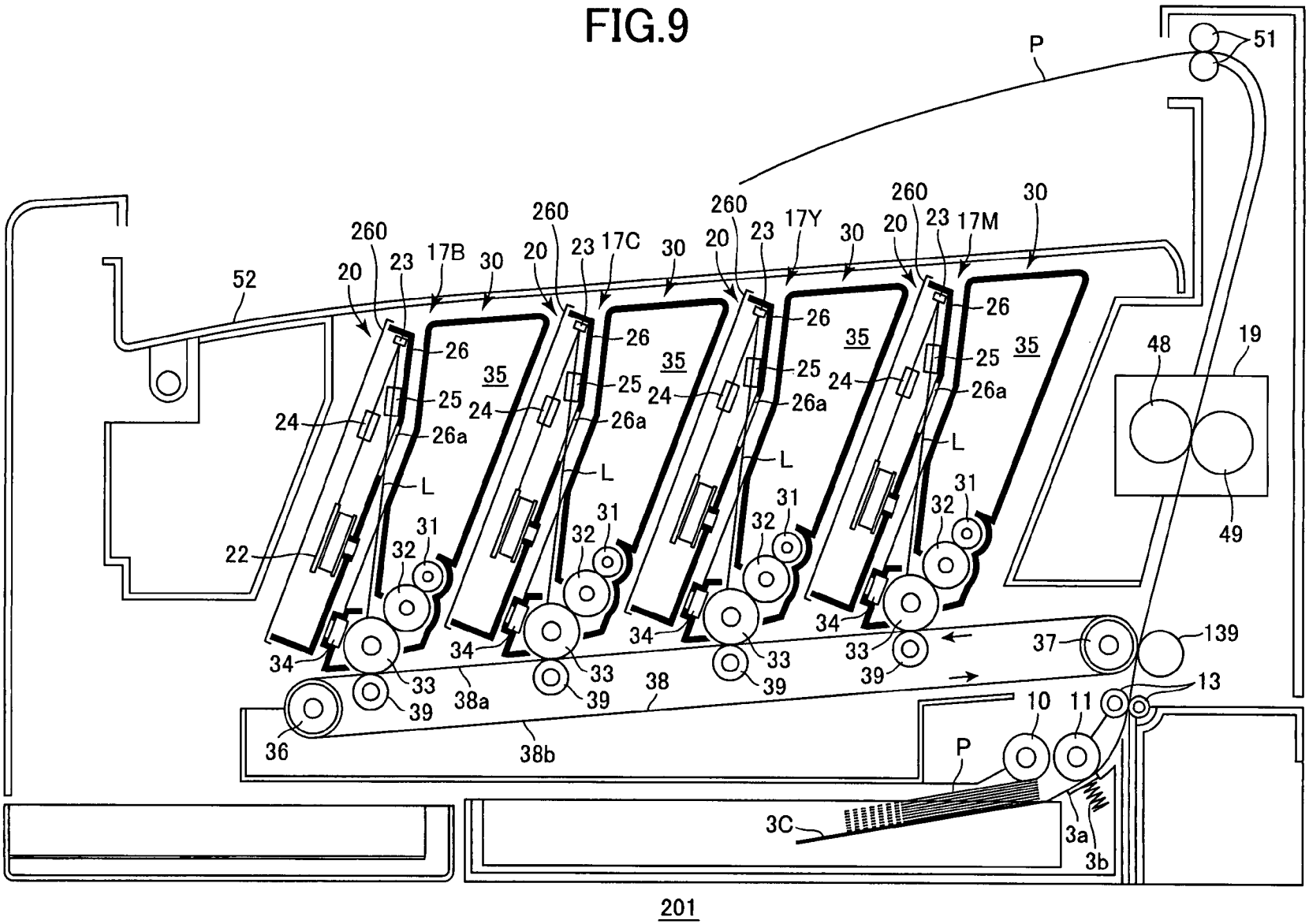
FIG. 9 is a side sectional view of the overall configuration of a modification of the color laser printer of FIG. 1.
Figure 10:
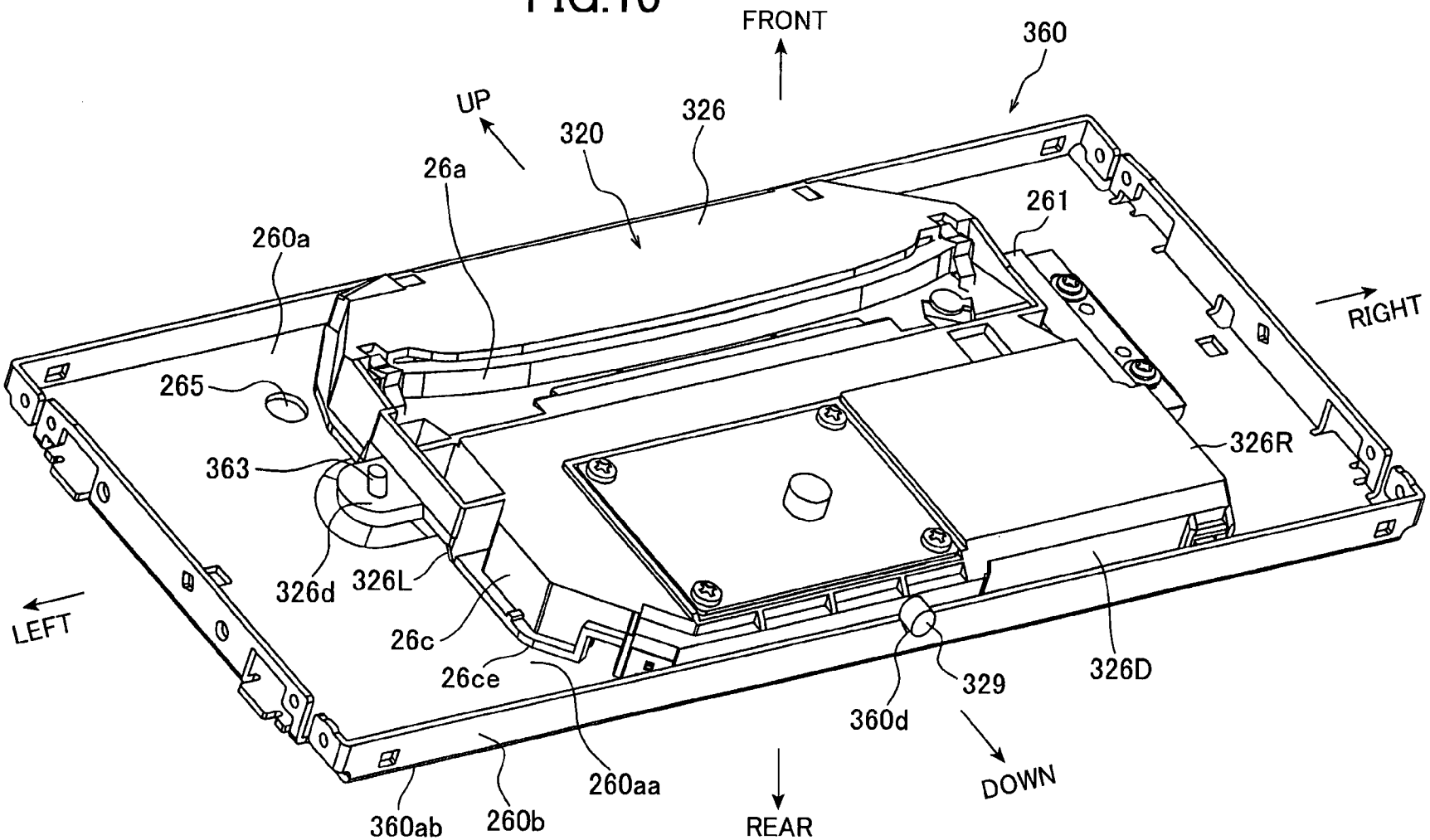
FIG. 10 is a perspective view of the scanner unit mounted on the scanner support frame according to a second embodiment and corresponds to FIG. 5 of the first embodiment.
Figure 11A:
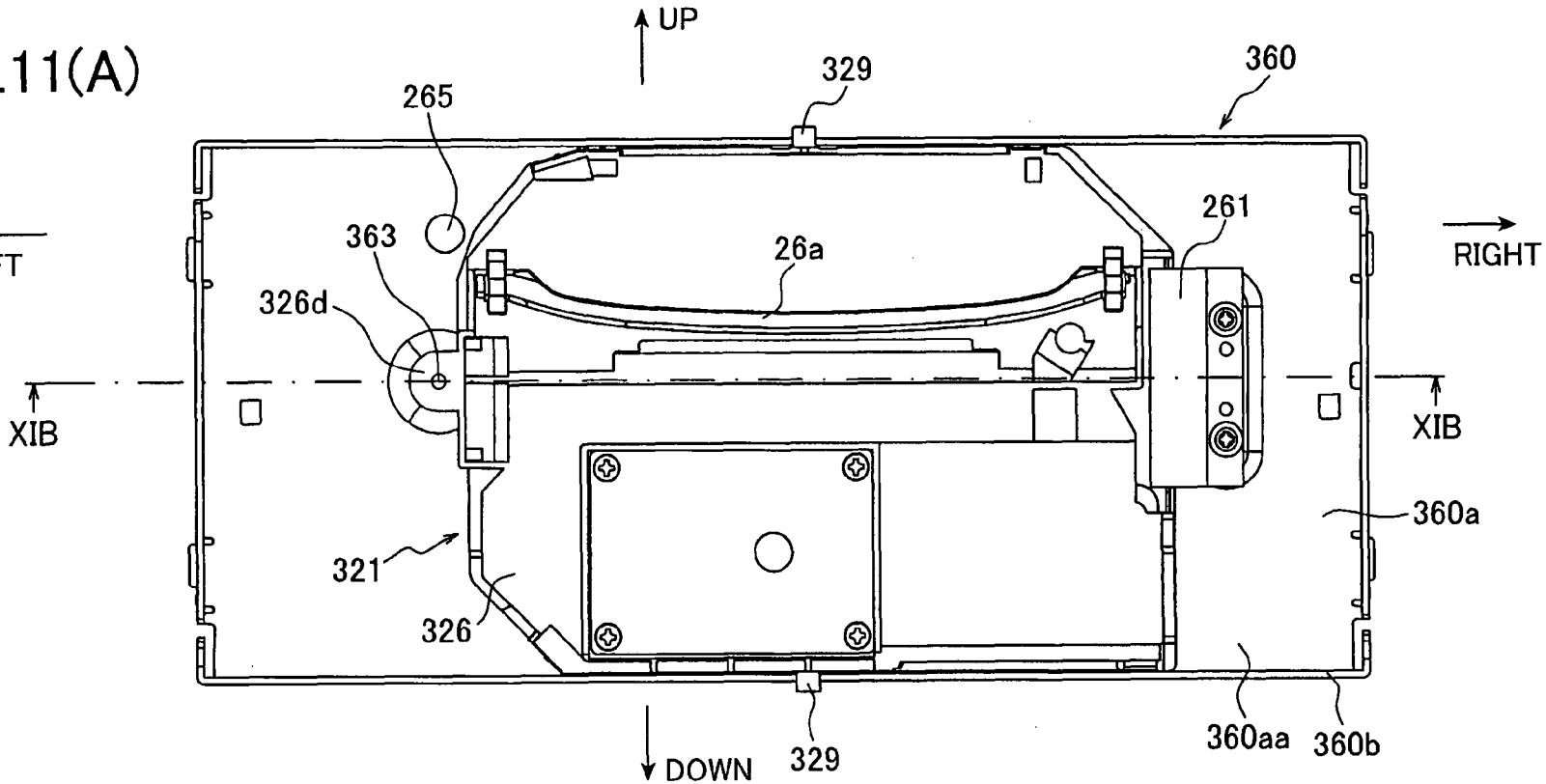
FIG. 11(A) is a plan view showing the outside of the scanner unit fixed to the scanner support frame shown in FIG. 10 and corresponds to FIG. 7(A)
Figure 11B:
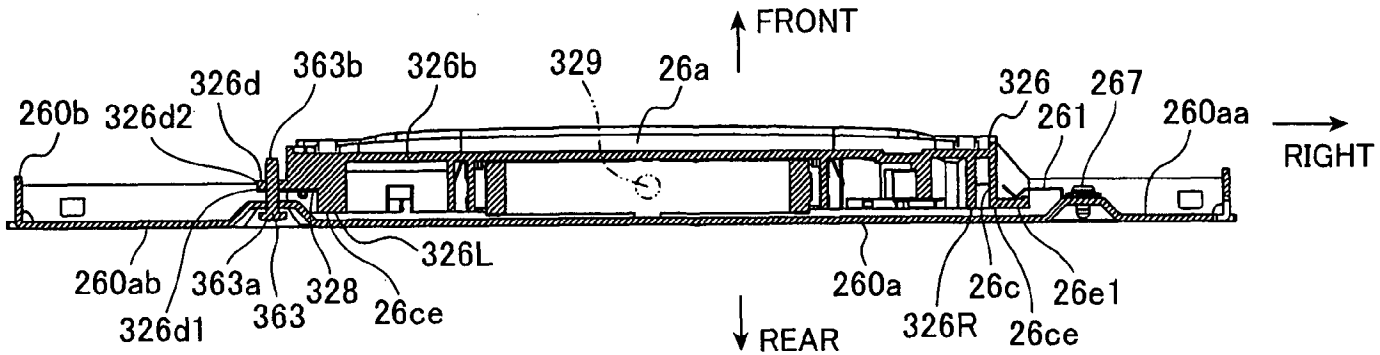
FIG. 11(B) is a sectional side view of the scanner unit fixed to the scanner support frame, taken along a line XIB-XIB in FIG. 11(A), and corresponds to FIG. 7(B)

In the above-described first embodiment, toner is transferred from each photosensitive drum 33 directly to the recording paper P that is being conveyed by the conveyor belt 38. However, in this modification, the configuration is modified into a color laser printer 201 shown in FIG. 9 such that the conveyor belt 38 acts as an intermediate transfer belt and toner is transferred thereon temporarily, before being transferred to the recording paper P from the conveyor belt 38.

More specifically, in this modification, an additional transfer roller 139 is provided so that the conveyor belt 38 is sandwiched between the additional transfer roller 139 and the follower roller 37. The additional transfer roller 139 is applied with a transfer bias.

Toner images of all the four colors are superimposed one on another on the upper side portion 38*a* of the conveyor belt 38, while being conveyed in the rearward direction. Then, the toner images are conveyed by the lower side portion 38*b* of the conveyor belt 38 in the forward direction, before finally reaching the nip portion between the conveyor belt 38 and the additional transfer roller 139. The toner images and one sheet of paper P supplied from the conveyor rollers 13 pass through the nip portion simultaneously with each other, and the toner images are transferred onto the paper P.

In this modification, though the conveying path for the recording paper P is different from that in the first embodiment, the device 201 can still be made compact by arranging the conveyor belt 38 to be inclined upward towards the front side.

Second Embodiment

Next, a color laser printer 301 according to a second embodiment will be described with reference to FIG. 1 and FIG. 10 to FIG. 12.

The color laser printer 301 is the same as the color laser printer 1 except that a combination of a scanner unit 320 and a scanner support frame 360 are used for each image forming portion 17, instead of the combination of the scanner unit 20 and the scanner support frame 260 in the first embodiment.

The scanner unit 320 is the same as the scanner unit 20 except that the scanner unit 320 has a scanner housing 326 instead of the scanner housing 26 of the first embodiment.

The scanner housing 326 is the same as the scanner housing 26 of the first embodiment except for the points described below.

Figure 12:
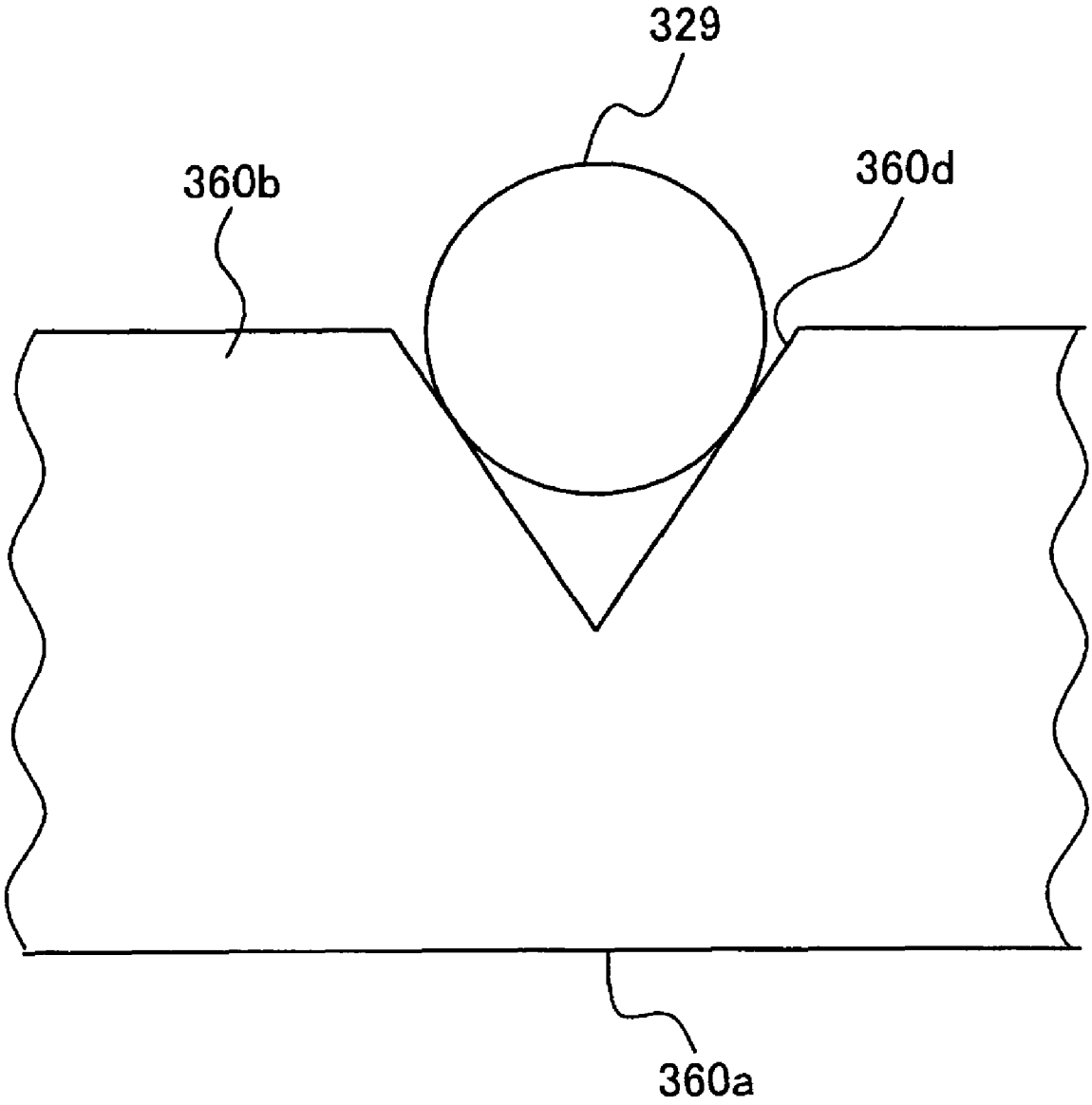
FIG. 12 is an enlarged sectional side view illustrating how a rotational shaft of the scanner unit is mounted on a bearing portion of the scanner support frame.

The scanner housing 326 has no protrusions 27, but instead has a rotational shaft 329. The rotational shaft 329 protrudes from the scanner housing 326 at its lower end 326D. The rotational shaft 329 is located on the scanner housing 326 at its substantially central position in the light scanning path, along which the light beam L is scanned by the polygon mirror 22. The rotational shaft 329 extends in a direction orthogonal to the scan direction of the laser beam L and substantially parallel with the tip end surface 26*ce* of the side wall 26*c* of the scanner housing 326. As shown in FIG. 12, the rotational shaft 329 has substantially a circular shape in its cross-section along an imaginary plane that extends parallel to the scanning direction (left-and-right direction) and perpendicularly to the tip end surface 26*ce*.

At a left end 326L, the scanner housing 326 is formed with no flange portion 26*d* or no steel plate 28, but instead is formed with a flange portion 326*d* and a steel plate 328, whose sizes are smaller than those of the flange portion 26*d* and the steel plate 28 in the first embodiment. The flange portion 326*d* has surfaces 326*d*1 and 326*d*2 opposite to each other. The steel plate 328 is fixed onto the surface 326*d*1 of the flange portion 326*d* that confronts the scanner support frame 360.

Instead of the screw 263 in the first embodiment, a screw 363 passes through the base plate 260*a* of the scanner support frame 360 from the outer surface 260*aa* of the base plate 260*a* to the inner surface 260*ab* of the base plate 260*a*. The screw 363 further passes through the steel plate 328 and flange portion 326*d*. Thus, a screw head 363*a* of the screw 363 is on the outer surface 260*ab* side, while a screw tip end 363*b* of the screw 363 is on the surface 326*d*2 side. Thus, the scanner unit 320 is engaged with the scanner support frame 360 at the left end 326L.

The support frame 360 is the same as the support frame 260 of the first embodiment except for the points described below.

The support frame 360 is formed with no depressions 262, but is instead formed with a bearing portion 360*d* for receiving the rotational shaft 329 on its side wall 260*b*.

The support frame 360 is mounted with no leaf spring 264 or no screw 266 of the first embodiment.

The bearing portion 360*d* opens in a V-shape as shown in FIG. 12, and therefore has a V-shaped cross-section along an imaginary plane that extends parallel to the scanning direction (left-and-right direction) and the base plate 260*a*.

The opening depth of the bearing portion 360*d* is sufficiently small that when the scanner unit 320 is supported on the support frame 360 with the rotational shaft 329 being received on the bearing portion 360*d*, the tip end surface 26*ce* of the side wall 26*c* of the scanner housing 326 that confronts the base plate 260*a* does not come into contact with the base plate 260*a*. This configuration enables adjustment of the orientation of the scanner unit 320 by pivoting the scanner unit 320 about the contact portion between the rotational shaft 329 and the bearing portion 360*d*.

Moreover, a right end 326R of the housing 326 is urged in the direction toward the base plate 260*a* by the combination of the screw 267 and the leaf spring 261 in the same manner as in the first embodiment. Accordingly, the orientation of the scanner unit 320 can be adjusted by adjusting the engagement amount of the screw 363, which engages the scanner unit 320 with the support frame 360 in the vicinity of the left end 326L of the housing 326.

Also in the second embodiment, the orientation of the scanner unit 320 can be adjusted easily, and the scanner unit 320 can be fixedly secured to the support frame 360 simultaneously with the completion of the adjustment. For that reason, the operation of fixing each scanner unit 320 to the corresponding support frame 360 is simple, which can improve the ease of operation.

In addition, since the orientation of the scanner unit 320 is adjusted about the axis of the rotational shaft 329 that is orthogonal to the scan direction, rotation of the scanner unit 320 about the center of an axis parallel to the scan direction can be prevented, making the above-described orientation adjustment even more simple.

Because the bearing portion 360*d* has the above-described configuration, even with such a simple configuration, the rotational shaft 329 can be held at a fixed position without being erroneously shifted therefrom.

Since the rotational shaft 329 is orthogonal to the scan direction, the scanner unit 320 is prevented from rotating about an axis that is parallel to the scan direction, further simplifying the adjustment of the orientation of the scanner unit 320 to ensure that the scanner unit 320 is oriented in the correct direction with respect to the photosensitive drum 33.

In addition, the right end portion 326R of the scanner housing 326 in the scan direction is urged toward the inner surface 260*aa* of the support frame 360 by the leaf spring 261, and the distance between the left end portion 326L and the surface 260*aa* of the support frame 360 is adjusted by the screw 363. Thus the scanner unit 320 can be fixed firmly to the support frame 360 at the same time as the orientation of the scanner unit 320 is adjusted relative to the support frame 360. The scanner unit 320 can therefore be supported on the support frame 360 stably after the adjustment.

Third Embodiment

A color laser printer 401 of the third embodiment will be described below with reference to FIG. 13-FIG. 20.

The color laser printer 401 is the same as the color laser printer 1 of the first embodiment except for the points described below.

In the first embodiment, the image forming portions 17K, 17C, 17Y, and 17M for the four colors of black, cyan, yellow, and magenta are arranged in this order from rear to front. On the other hand, in the third embodiment, the image forming portions 17K, 17C, 17M, and 17Y for the four colors of black, cyan, magenta, and yellow are arranged in this order from rear to front.

A belt unit 60 is configured by mounting, into a belt unit frame 61, the transfer portion 18 (the drive roller 36, follower roller 37, conveyer belt 38, transfer rollers 39, and belt cleaning unit 40), the pickup roller 10, the paper supply roller 11, the rear conveyor roller 13*b*, and the pair or registration rollers 14 and by integrating them together as a unit. The belt unit 60 can be moved horizontally (front-and-rear direction), and can be inserted into and removed from the front side of the main body casing 2.

Figure 13:
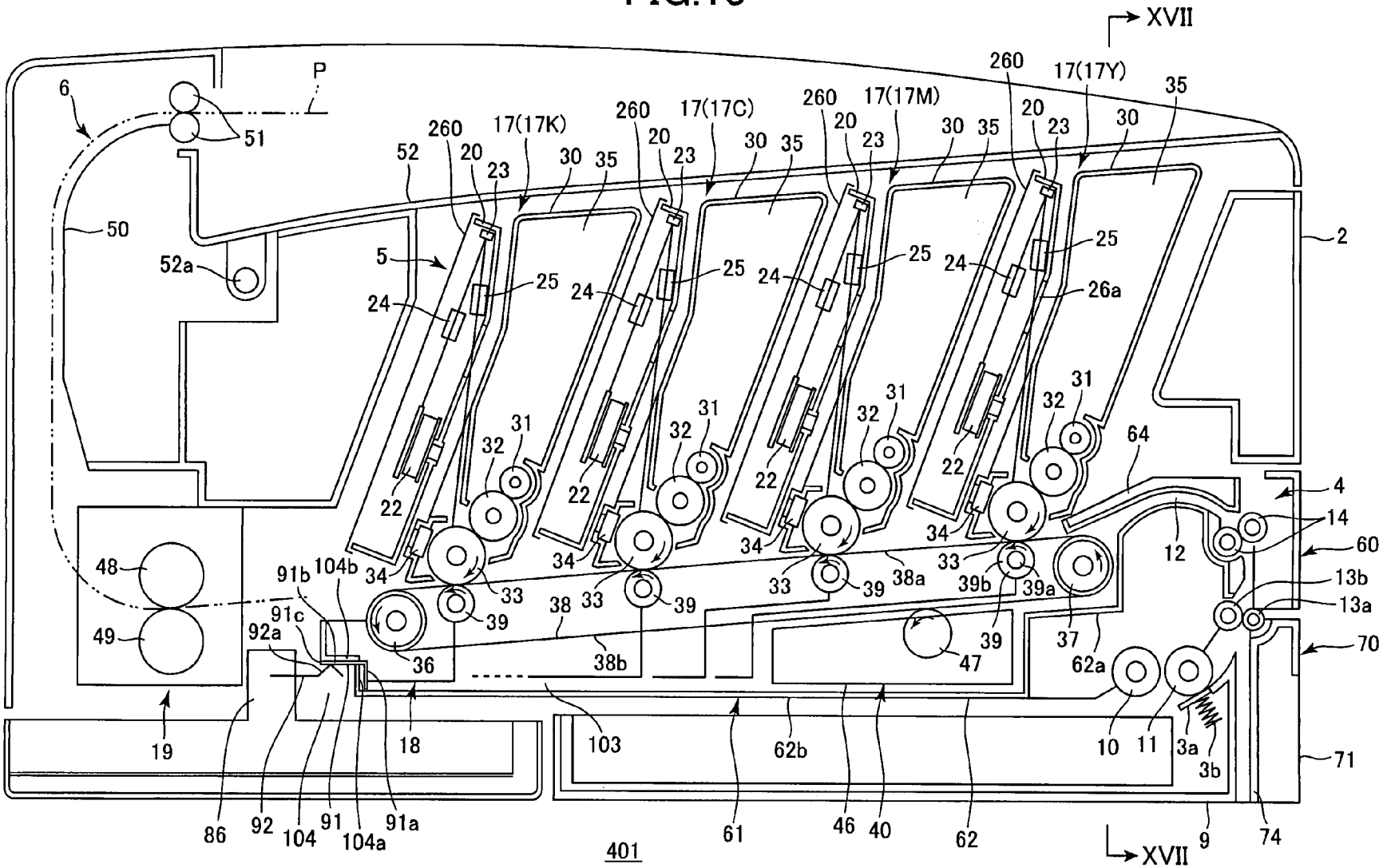
FIG. 13 is a sectional side view of a color laser printer according to a third embodiment.

When the belt unit 60 is mounted in the main casing 2 at its installation position, as shown in FIG. 13, the conveyor belt 38 is contact with the photosensitive drums 33 in the same manner as in the first embodiment, and terminals 91 (to be described later) on the belt unit 60 are in contact with electrodes 92 (to be described later) in the main casing 2. When the belt unit 60 is moved in the forward direction to separate from the installation position, the conveyor belt 38 is separated from the photosensitive drums 33, and thereafter rear edges 91*c* of the terminals 91 are separated from the electrodes 92 as will be described later.

Figure 15:
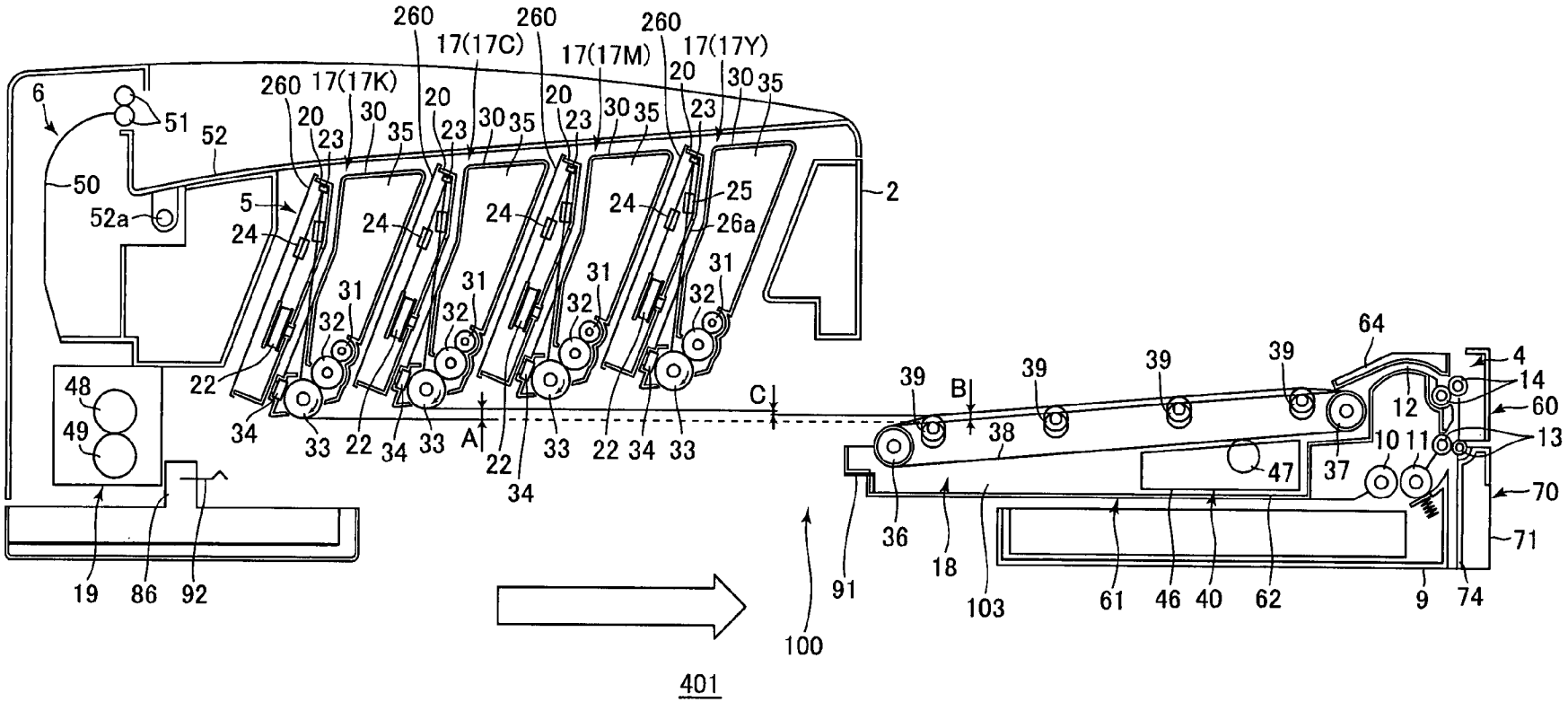
FIG. 15 is a sectional side view showing a state in which the paper supply cassette and a belt unit are withdrawn from the color laser printer of FIG. 13.

It is noted that as shown in FIG. 15, similarly to the first embodiment, the vertical position of each process cartridge 30 is higher than that of its rear-side neighboring process cartridge 30 by the predetermined amount (which will be referred to as amount "A", hereinafter). That is, the offset between the vertical position of the process cartridge 30 in the black image-forming portion 17K and the vertical position of the process cartridge 30 in the cyan image-forming portion 17C, the offset between the vertical position of the process cartridge 30 in the cyan image-forming portion 17C and the vertical position of the process cartridge 30 in the magenta image-forming portion 17M, and the offset between the vertical position of the process cartridge 30 in the magenta image-forming portion 17M and the vertical position of the process cartridge 30 in the yellow image-forming portion 17Y are all equal to the predetermined amount A. Accordingly, when the process cartridges 30 for all the colors are installed in the image-forming portions 17, the photosensitive drums 33 in the process cartridges 30 of the different colors are disposed in such a manner that a line connecting the lower sides of the photosensitive drums 33 is higher on the upstream side of the direction of installation of the belt unit 60 and inclines downward on the downstream side of the direction of installation of the belt unit 60.

Similarly to the first embodiment, the space below the image-forming section 5 and above the sheet supply cassette 70 has a shape in which the height in the vertical direction narrows towards the rear as seen from the side. The belt unit 60 is installed in this space of the tapered shape, and therefore the belt unit 60 is formed to have an overall shape as seen from the side that narrows in the vertical direction towards the rear side, in correspondence with the tapered shape of this installation space. That is, similarly to the first embodiment, the follower roller 37 is disposed higher than the drive roller 36.

When the belt unit 60 is installed in the installation position in the main casing 2, the follower roller 37 is disposed forward from the photosensitive drum 33 of the process cartridge 30 that is installed in the yellow image-forming portion 17Y.

The upper side portion 38*a* of the conveyor belt 38 is inclined, with an angle being formed between the direction of motion of the upper side portion 38*a* that is caused by driving of the drive roller 36 and the horizontal direction (the direction in which the belt unit 60 is withdrawn from the color laser printer 1) is such that the contacts between the surface of the conveyor belt 38 and the photosensitive drums 33 are released simultaneously when the belt unit 60 is moved from the installation position in the forward direction so as to be removed from the main casing 2.

Figure 17:
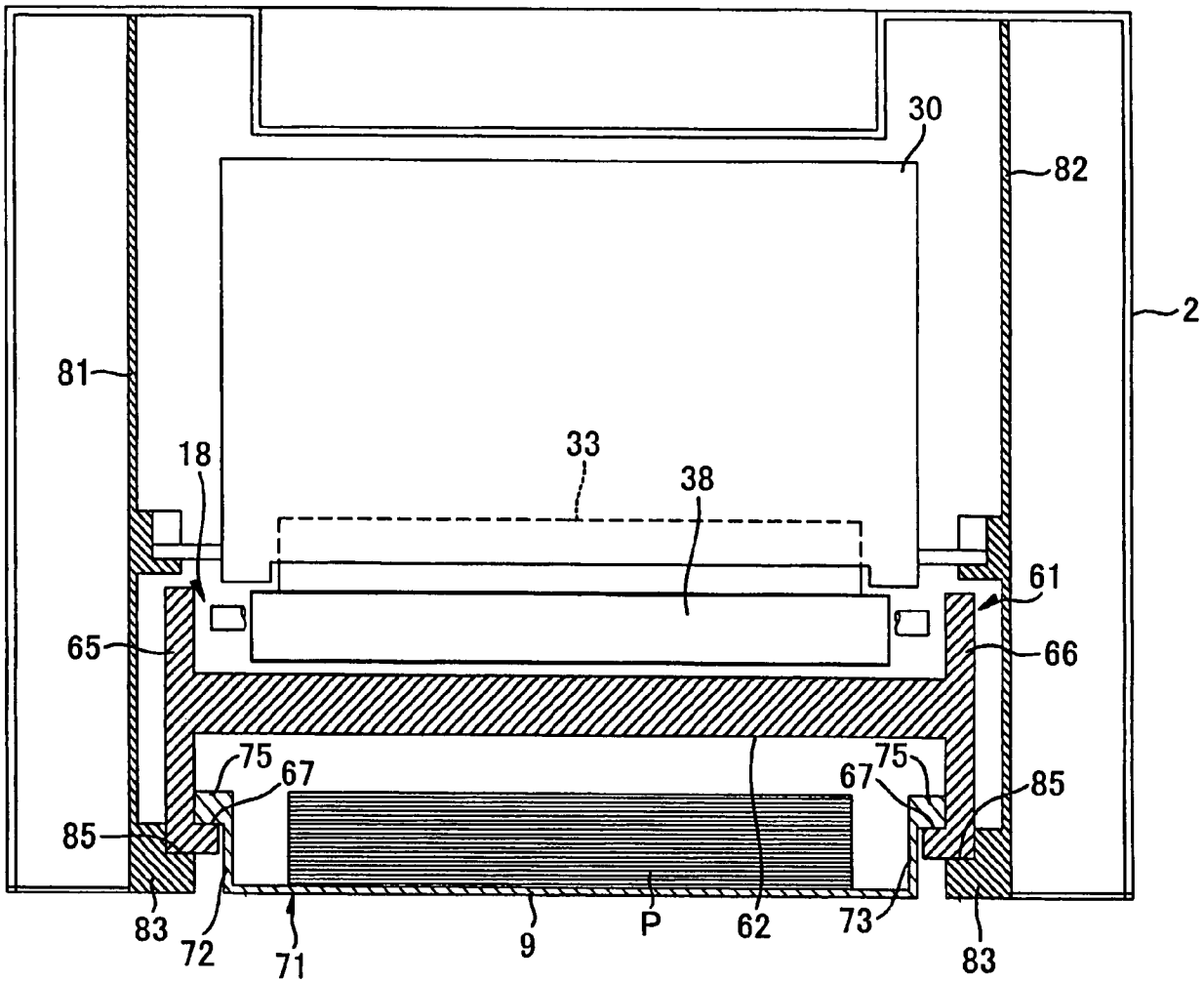
FIG. 17 is a front section of the color laser printer of FIG. 13 taken along a line XVII-XVII.

As shown in FIG. 17, the belt unit frame 61 includes: a left-side plate 65 and a right-side plate 66; a base plate 62; and a paper guide member 64. The left-side plate 65 and right-side plate 66 are disposed facing each other in the widthwise direction at a certain distance apart. The base plate 62 is suspended between the left-side plate 65 and right-side plate 66. As shown in FIG. 13, the paper guide member 64 is suspended in a swingable manner between the left-side plate 65 and the right-side plate 66 above the front end of the base plate 62, for guiding a paper P that is being conveyed through the paper supply side U-shaped path 12 onto the conveyor belt 38.

The pickup roller 10, the paper supply roller 11, the rear conveyor roller 13*b*, the pair of registration rollers 14, the drive roller 36, and the driven roller 37 are suspended between the left-side plate 65 and the right-side plate 66 in this belt unit frame 61 in a rotatable manner.

The transfer rollers 39 are suspended between the left-side plate 65 and the right-side plate 66 so that each transfer roller 39 is rotatable about its axis and is movable in the vertical direction.

Figure 19:
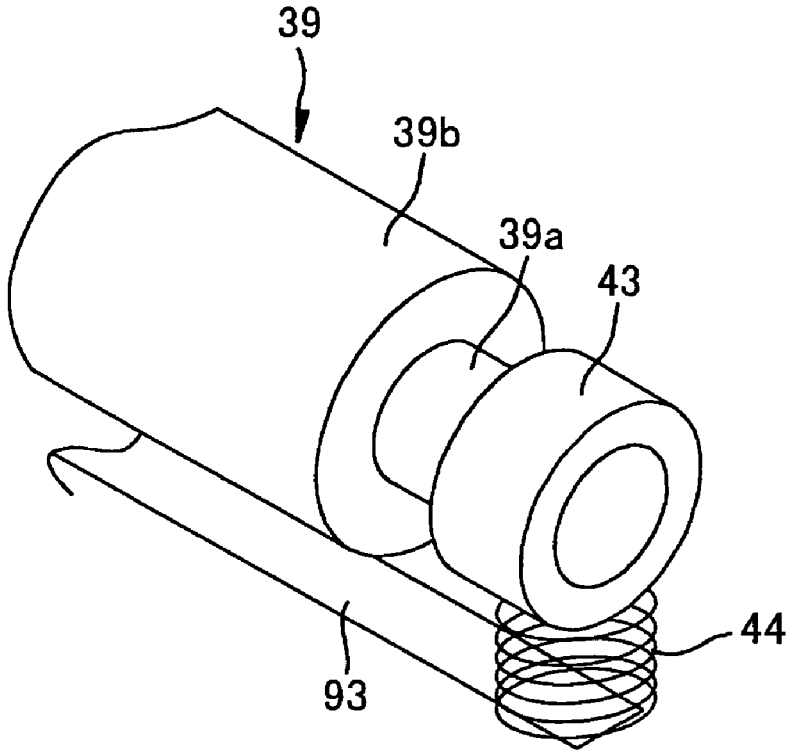
FIG. 19 is a perspective view of a shaft end portion of a transfer roller shown in FIG. 18.

As will be described later with reference to FIG. 19, each transfer roller 39 is urged upwardly by compression springs 44. Accordingly, when the belt unit 60 is installed in the main casing 2 at the installation position shown in FIG. 13, the conveyor belt 38 is sandwiched between each transfer roller 39 and the corresponding photosensitive drum 33.

More specifically, as will be described later with reference to FIG. 18, left-side and right-side ends of the roller shaft 39*a* of each transfer roller 39 are rotatably supported by left-side and right-side bearings 43, respectively. The bearings 43 are supported as being vertically movable in the belt unit frame 61. Left-side and right-side compression springs 44 are also mounted in the belt unit frame 61 to press the transfer rollers 39 upwardly. Accordingly, when the belt unit 60 is located in the installation position as shown in FIG. 13, the transfer rollers 39 press the conveyor belt 38 against the photosensitive drums 33 to form nips (image formation positions) between the photosensitive drums 33 and the conveyor belt 38.

As shown in FIG. 13, the base plate 62 has a front area 62*a* and a middle-to-rear area 62*b*, which are arranged in the front-to-rear direction. The front area 62*a* faces the follower roller 37 of the conveyor belt 38. The middle-to-rear area 62*b* is positioned lower than the front area 62*a*, and therefore defines thereon a depression 103 that sinks lower than the front area 62*a*. The belt cleaning device 40 is disposed within a front portion in the depression 103.

Figure 18:
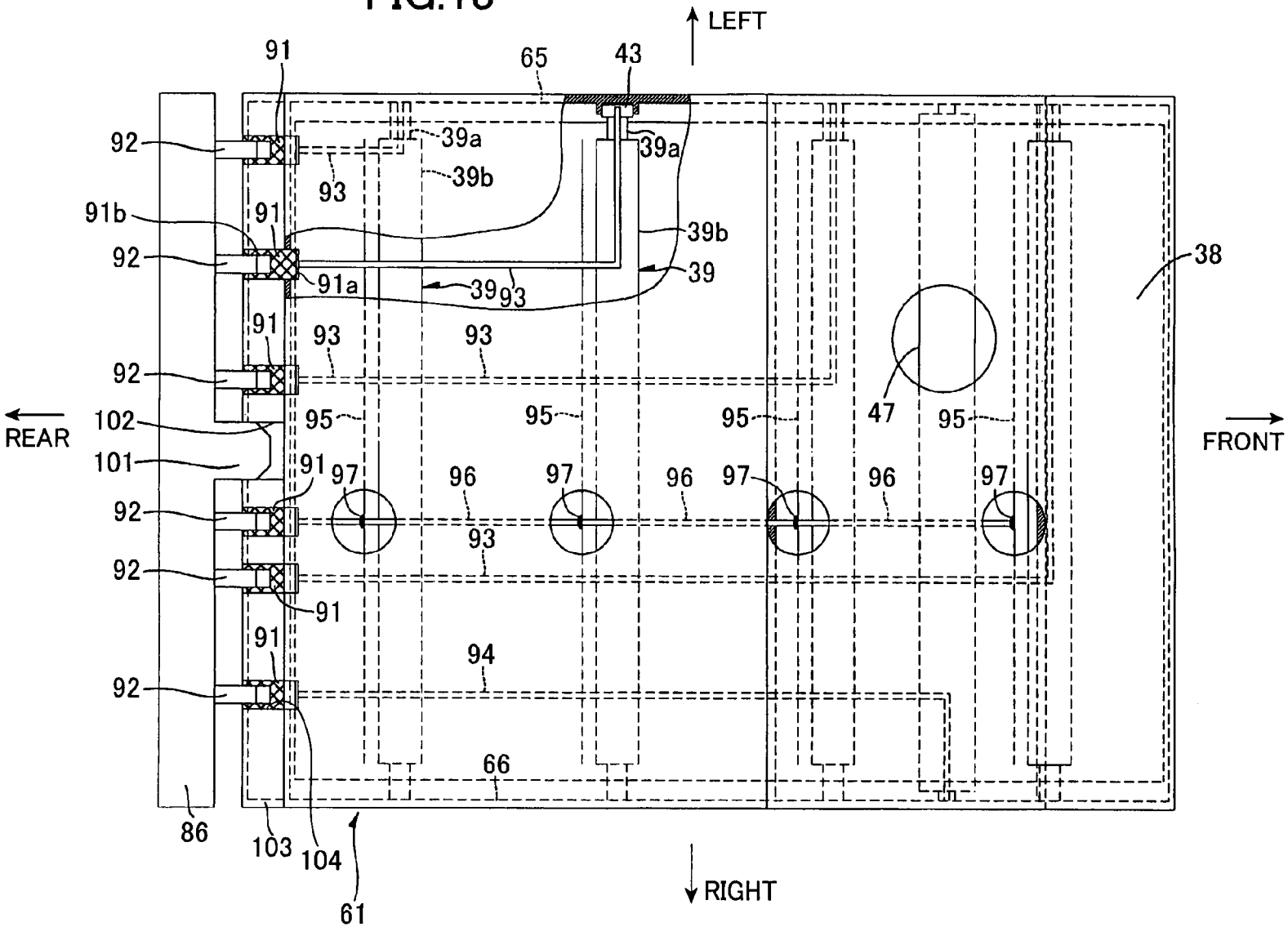
FIG. 18 is a bottom view of the belt unit.

As shown in FIG. 13 and FIG. 18, a positioning groove 102 and a plurality of (six, in this example) terminal grooves 104 are formed at a rear edge of the base plate 62. As shown in FIG. 13, each terminal groove 104 has a vertical wall 104*a* and a horizontal wall 104*b*.

As shown in FIG. 17, the lower end portion of each of the left-side plate 65 and the right-side plate 66 bends inward in the widthwise direction, to form a sheet supply cassette guide 67 for guiding the sheet supply cassette frame 71 of the sheet supply cassette 70 to insert or remove the sheet supply cassette 70.

The sheet supply cassette frame 71 has: a left-side plate 72 and a right-side plate 73; and a front plate 74 (see FIG. 13). The left-side plate 72 and right-side plate 73 are disposed facing each other in the widthwise direction at a certain distance apart. The front plate 74 is suspended between front end portions of the left-side plate 72 and the right-side plate 73. The sheet supply cassette frame 71 holds the paper tray 9 between the left-side plate 72 and the right-side plate 73 at a location rear to the front plate 74.

The left-side plate 72 faces the left-side plate 65 of the belt unit frame 61 with a predetermined spacing therebetween, and the right-side plate 73 faces the right-side plate 66 of the belt unit frame 61 with a predetermined spacing therebetween.

Each of the left-side plate 72 and the right-side plate 73 has a stretched portion 75. The stretched portion 75 stretches out from an upper end of a corresponding plate 72 or 73 towards the outer side in the widthwise direction and extends in the direction from front to rear. The stretched portions 75 of the left-side and right-side plates 72 and 73 are engaged from above onto the paper supply unit guides 67 of the belt unit frame 61. The sheet supply cassette frame 71 is therefore held on the belt unit frame 61 so that the sheet supply cassette frame 71 is slidable horizontally along the paper supply unit guides 67.

The main casing 2 has a left main casing side plate 81 and a right main casing side plate 82. When the belt unit 60 is installed in the main casing 2, the left main casing side plate 81 faces the left-side plate 65 with a predetermined spacing therebetween, and the right main casing side plate 82 faces the right-side plate 66 of the belt unit frame 61 with a predetermined spacing therebetween.

Each of the left main casing side plate 81 and the right main casing side plate 82 is formed with a belt unit guide 83 at its lower end. The belt unit guide 83 protrudes inward in the widthwise direction and extends in the front-to-rear direction by a length that is sufficiently long to receive the entire length of the belt unit frame 61. Each belt unit guide 83 is formed with a guide portion 85. The guide portion 85 is a rectangular cutout formed on an upper edge of the belt unit guide 83 and extends along the inner side of the belt unit guide 83 in the widthwise direction along the entire length of the belt unit guide 83 in the lengthwise direction. The belt unit frame 61 can slide horizontally along the guide portions 85 of the belt unit guides 83 when the lower ends of the left-side plate 65 and the right-side plate 66 are mounted on the guide portions 85.

As shown in FIG. 13, the main casing 2 is also provided with an electrode holder 86. The electrode holder 86 is disposed at a location that the electrode holder 86 faces the rear edge of the belt unit frame 61 when the belt unit 60 is installed in the main casing 2. As shown in FIG. 18, a plurality of (six, in this example) electrodes 92 are held in the electrode holder 86. The electrodes 92 are arrayed in the widthwise direction. Each electrode 92 extends forward.

As shown in FIG. 18, a positioning protrusion 101 protrudes forwardly from the front surface of the electrode holder 86 at its central portion in the widthwise direction. The positioning protrusion 101 has a substantially rectangular shape as seen from the bottom as shown in FIG. 18.

As shown in FIG. 13 and FIG. 18, terminals 91 are provided in the rear edge of the belt unit frame 61 at the terminal grooves 104. The terminals 91 serve as power supply terminals that are brought into contact with the corresponding electrodes 92 when the belt unit 60 is installed in the main casing 2.

As shown in FIG. 13, each terminal 91 is of an L-shape, and has a vertically-extending portion 91*a* and a horizontally-extending portion 91*b*. The vertically-extending portion 91*a* extends vertically along the front-facing surface of the vertical wall 104*a* of the terminal groove 104. At the upper end of the vertically-extending portion 91*a*, the terminal 91 bends rearwardly so that the horizontally-extending portion 91*b* passes through the vertical wall 104*a* to protrude from the inside of the belt unit frame 61 outwardly to the outside of the belt unit frame 61. The horizontally-extending portion 91*b* extends horizontally (rearwardly) along an underside surface of the horizontal wall 104*b* of the terminal groove 104. Thus, the lower surface of the horizontally-extending portion 91*b* of each terminal 91 can contact the contact point 92*a* of the corresponding electrode 92 when the belt unit frame 61 is installed in the main casing 2 as shown in FIG. 13.

The distance between the rear edges 91*c* of the terminals 91 and each transfer roller 39 is greater than or equal to the distance between the contact points 92*a* of the electrodes 92 and the corresponding photosensitive drum 33. More specifically, the distance between the rear edges 91*c* and the transfer roller 39 for black is greater than or equal to the distance between the contact points 92*a* and the photosensitive drum 33 for black. The distance between the rear edges 91*c* and the transfer roller 39 for cyan is greater than or equal to the distance between the contact points 92*a* and the photosensitive drum 33 for cyan. The distance between the rear edges 91*c* and the transfer roller 39 for magenta is greater than or equal to the distance between the contact points 92*a* and the photosensitive drum 33 for magenta. The distance between the rear edges 91*c* and the transfer roller 39 for yellow is greater than or equal to the distance between the contact points 92*a* and the photosensitive drum 33 for yellow. It is noted that in the front-to-rear direction, the distance between the photosensitive drums 33 for black and cyan, the distance between the photosensitive drums 33 for cyan and magenta, and the distance between the photosensitive drums 33 for magenta and yellow are equal to the distance between the transfer rollers 39 for black and cyan, the distance between the transfer rollers 39 for cyan and magenta, and the distance between the transfer rollers 39 for magenta and yellow, respectively. Accordingly, when the belt unit 60 is inserted in the main casing 2 from its front side and is moved rearwardly, either simultaneously with or after the rear edges 91*c* of the terminals 91 come into contact with the contact points 92*a* of the electrodes 92, the transfer rollers 39 reach the positions exactly below the corresponding photosensitive drums 33 as shown in FIG. 13. In other words, when the belt unit 60 is inserted in the main casing 2 and is moved rearwardly, the belt unit 60 reaches the installation position of FIG. 13 where the conveyor belt 38 contact the photosensitive drums 33, either simultaneously with or after the rear edges 91*c* of the terminals 91 have come into contact with the contact points 92*a* of the electrodes 92.

As shown in FIG. 18, the positioning protrusion 101 fits into the positioning groove 102 when the belt unit frame 61 is installed in the main casing 2. The belt unit frame 61 can be positioned with respect to the main casing 2 in the widthwise direction by fitting the positioning protrusion 101 into the positioning groove 102.

Erroneous positioning, in the widthwise direction, of the terminals 91 provided on the belt unit frame 61 with respect to the electrodes 92 held on the electrode holder 86 can be prevented by using the positioning protrusion 101 as reference for positioning the belt unit frame 61 with respect to the main casing 2 in the widthwise direction. For that reason, reliable connections can be achieved between the terminals 91 and the corresponding electrodes 92.

The belt unit frame 61 further supports therein: four transfer bias lines 93 for supplying a transfer bias to the four transfer rollers 39; a cleaning bias line 94 for supplying a cleaning bias to the cleaning roller 47; and a neutralization bias line 96 for supplying a neutralization bias to four neutralization combs 95. Each neutralization comb 95 is provided along a corresponding transfer roller 39.

It is noted that each transfer roller 39 and each neutralization comb 95 are located between the upper side portion 38*a* and the lower side portion 38*b* of the endless belt 38 in the vertical direction. In this example, the conveyor belt 38 is configured of a plurality of strips of endless belts, which are wound around the drive roller 36 and the follower roller 37 and which are arranged adjacent to one another in the widthwise direction. A small amount of widthwise gap (inter-strip gap) is formed between each two adjacent strips of endless belt.

Each transfer bias line 93 has one end connected to one of the terminals 91, and the other end connected to a left-side end of the corresponding transfer roller 39. More specifically, from the terminal 91, the transfer bias line 93 extends forwardly, then bends upwardly to pass through one inter-strip gap between two neighboring belt strips to enter the space between the upper and lower side portions 38*a* and 38*b* of the conveyer belt 38, and then bends leftwardly, before finally reaching the left-side end of the corresponding transfer roller 39.

It is noted that as shown in FIG. 18, the left-side and right-side ends of the roller shaft 39*a* of each transfer roller 39 are rotatably supported by the left-side and right-side bearings 43, respectively. The left-side and right-side bearings 43 are electrically conductive, and are mounted on the left-side and right-side compression springs 44, respectively. The left-side and right-side compression springs 44 are also electrically conductive and are supported by the left-side and right-side plates 65 and 66, respectively. FIG. 19 shows how the left-side end of the roller shaft 39*a* is supported by the left-side bearing 43 and how the left-side bearing 43 is supported on the left-side compression spring 44. Each bearing 43 is pressed upwardly by the corresponding compression spring 44. As shown in FIG. 18, the left-side and right-side bearings 43 are guided by the left-side and right-side plates 65 and 66, respectively, so that the bearings 43 can slidingly move in the vertical direction along the left-side and right-side plates 65 and 66. As shown in FIG. 19, the transfer bias line 93 is connected to the left-side compression spring 44. The transfer bias line 93 is therefore connected to the left end of the transfer roller 39 via the left-side compression spring 44 and the left-side bearing 43.

Thus, each transfer bias line 93 is connected to the compression spring 44 that is linked to a bearing 43 for a corresponding transfer roller 39. A transfer bias is therefore applied to each transfer roller 39 from the corresponding transfer bias line 93 through the corresponding compression spring 44 and bearing 43.

The cleaning bias line 94 has one end connected to the corresponding terminal 91, and the other end connected to a right-side end of the cleaning roller 47. More specifically, from the corresponding terminal 91, the cleaning bias line 94 extends forwardly, then bends rightwardly and upwardly before finally reaching the right-side end of the cleaning roller 47.

The neutralization bias line 96 has one end connected to the corresponding terminal 91. From the terminal 91, the neutralization bias line 96 extends rearwardly, then bends upwardly to pass through one inter-strip gap between two neighboring belt strips to enter the space between the upper and lower side portions 38*a* and 38*b* of the conveyer belt 38, and then bends to extend forwardly to connect with the neutralization combs 95 for the image-forming portions 17K, 17C, 17M, and 17Y in succession.

Figure 20:
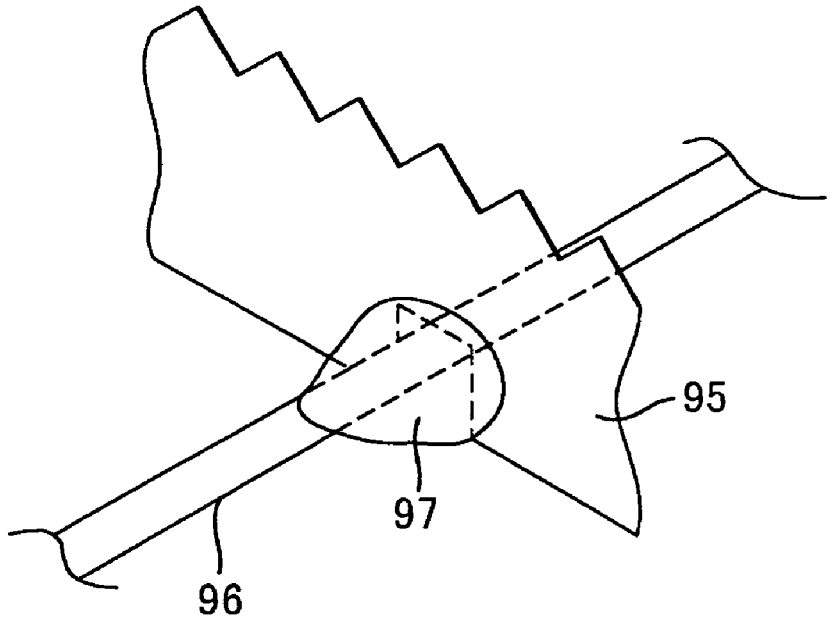
FIG. 20 is a perspective view of a connection between a neutralization bias line and a neutralization comb shown in FIG. 18.

As shown in FIG. 20, each neutralization comb 95 is formed with a through-hole, through which the neutralization bias line 96 passes, and is connected to the neutralization bias line 96 by electrically-conductive material 97 such as solder. The upper edge portion of each neutralization comb 95 is formed with a large number of mountain-shaped protrusions, and comes into contact with the lower surface of the upper side portion 38*a* of the conveyor belt 38.

According to the configuration described above, the belt unit 60 can be inserted into or removed from the main casing 2 along a linear insertion/removal path 100, as shown in FIG. 15, that extends horizontally from the front, by sliding the belt unit frame 61 along the guide portions 85 of the belt unit guides 83.

Figure 14:
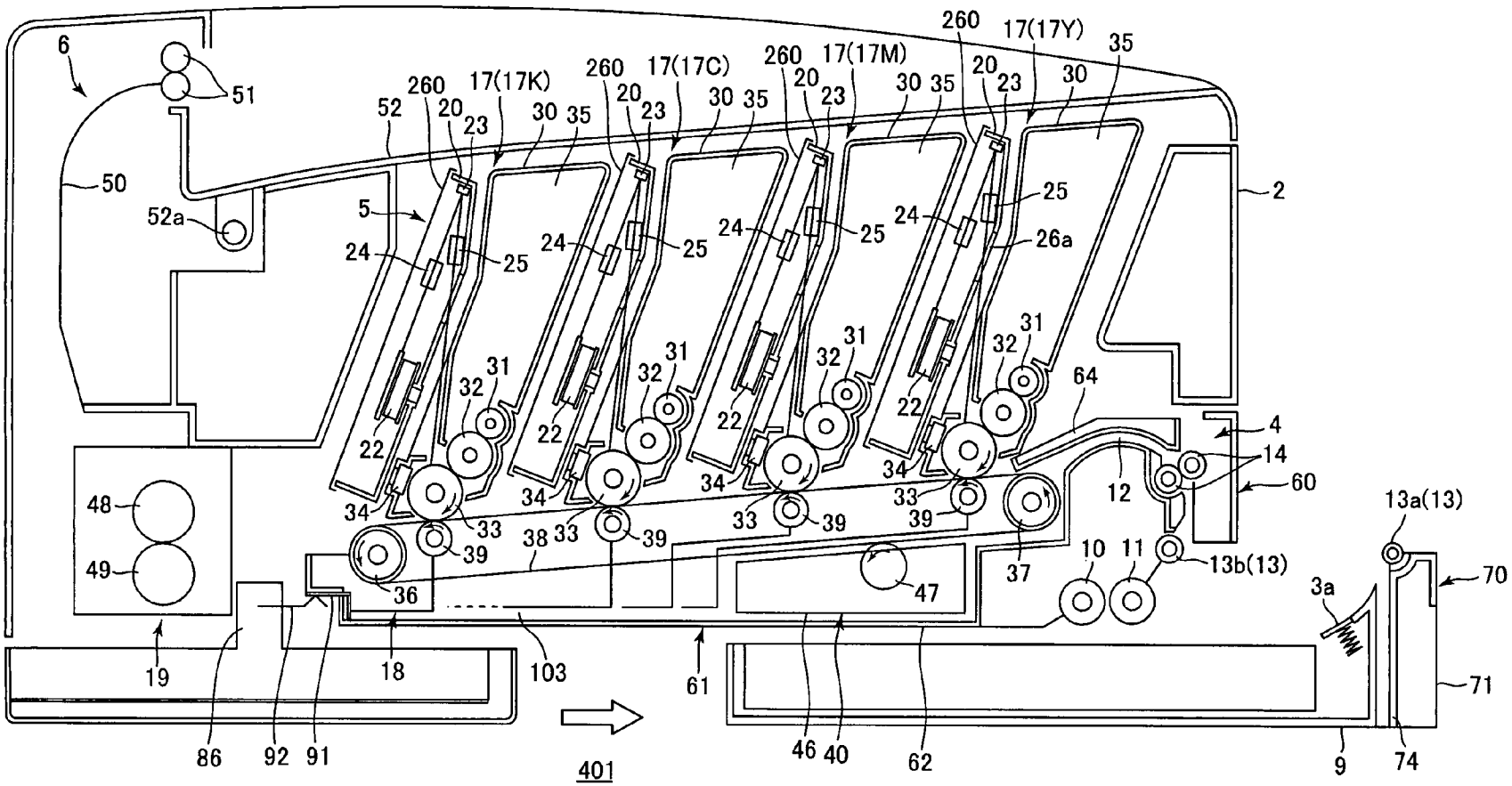
FIG. 14 is a sectional side view showing a state in which a sheet supply cassette is withdrawn from the color laser printer of FIG. 13.

The sheet supply cassette 70 can also be inserted or removed horizontally from the front of the main casing 2 and the belt unit 60, by sliding the sheet supply cassette frame 71 along the paper supply unit guides 67 as shown in FIG. 14.

This ensures that the sheet supply cassette 70 alone can be inserted into and removed from the main casing 2, as shown in FIG. 14.

In addition, the belt unit 60 can be inserted into or removed from the main casing 2 together with the sheet supply cassette 70.

More specifically, as shown in FIG. 14 and FIG. 15, the belt unit 60 and the sheet supply cassette 70 are disposed to partly overlap with each other in the vertical direction. Accordingly, as shown in FIG. 15, when the belt unit 60 is desired to be removed from the main casing 2, by pulling out the belt unit 60 forwardly, the lower front portion of the belt unit 60, that is, the rollers 13*a* and 11, for example, push forward the sheet supply cassette 70, thereby enabling the belt unit 60 and the sheet supply cassette 70 to be removed together from the main casing 2. When the belt unit 60 and the sheet supply cassette 70 are desired to be mounted into the main casing 2, the integral unit of the belt unit 60 and the sheet supply cassette 70 is moved rearwardly by pushing the front surface of the sheet supply cassette 70 rearwardly, as a result of which the upper front portion of the sheet supply cassette 70, that is, the roller 13*b* and the separation pad 3*a*, for example, push rearward the belt unit 60, thereby enabling the belt unit 60 and the sheet supply cassette 70 to be mounted together in the main casing 2. In this way, the integral unit of the belt unit 60 and the sheet supply cassette 70 are inserted into or removed from the main casing 2 in the same direction as that in which the sheet supply cassette 70 alone is inserted or removed. For that reason, the belt unit 60 and the sheet supply cassette 70 can be inserted or removed by a single operation. As a result, the ease of operation during the insertion or removal of the belt unit 60 and the sheet supply cassette 70 can be improved.

Moreover, when both the belt unit 60 and the sheet supply cassette 70 are withdrawn from the main casing 2 as shown in FIG. 15, a large space is formed below the image-forming section 5. When a paper P is jammed in the fixing portion 19, for example, it is possible to easily remove the paper P from the inside of the main casing 2 by inserting a user's hand into the large space from the front.

With this color laser printer 401, the insertion/removal path 100 extends horizontally without bending, and the belt unit 60 can be moved in a straight line from the start of withdrawal from the main casing 2 to the completion thereof. In addition, the belt unit 60 can be moved along the insertion/removal path 100 in a straight line with respect to the main casing 2 from the start of installation to the completion thereof. For that reason, the operation of inserting or removing the belt unit 60 with respect to the main casing 2 can be done extremely easily.

Figure 16:
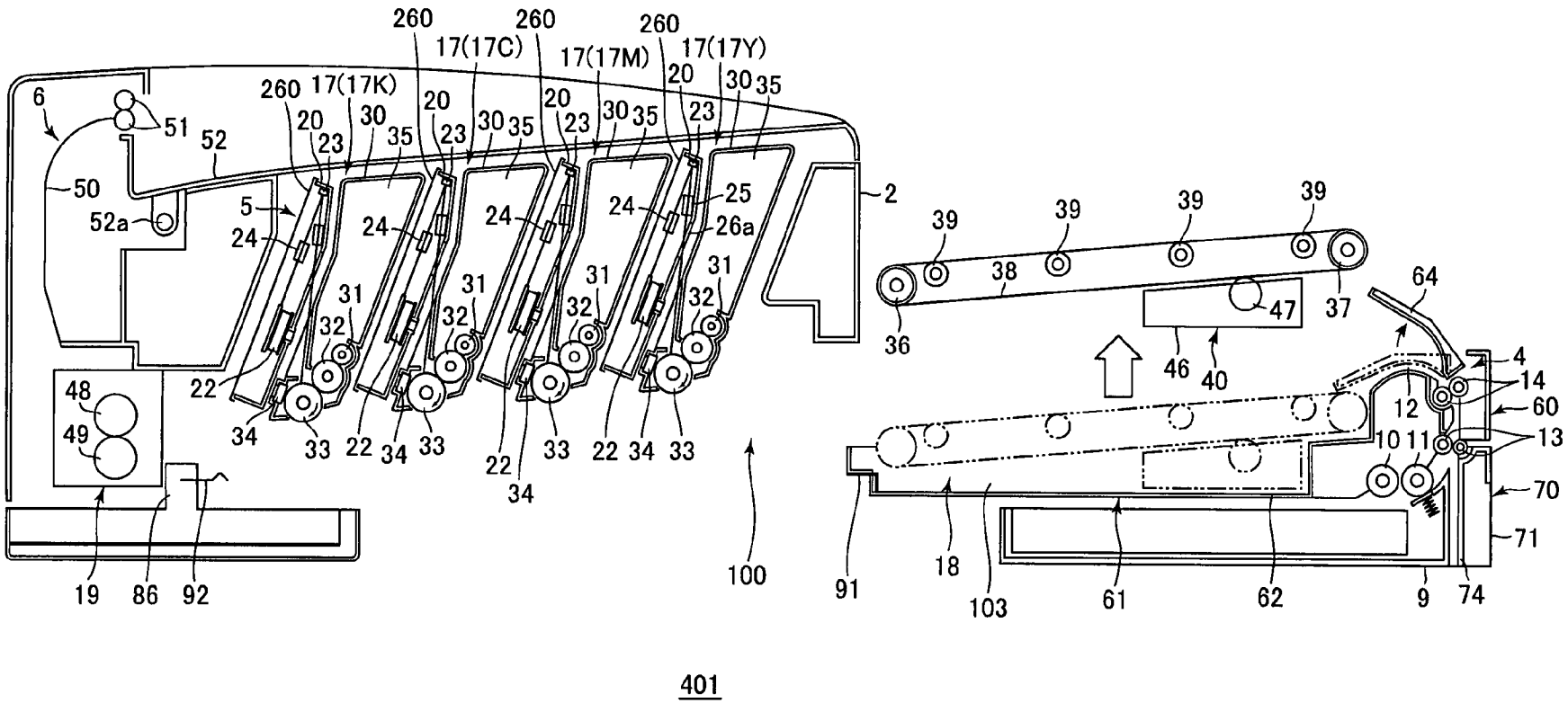
FIG. 16 is a sectional side view of a state in which the conveyor belt and a belt cleaning device are removed from the belt unit of FIG. 15.

After withdrawing the belt unit 60 from the main casing 2 as shown in FIG. 16, by turning the paper guide member 64 upwardly, it becomes possible to raise the conveyor belt 38 and the belt cleaning device 40 from the belt unit 60, either together or separately, and take the conveyor belt 38 and the belt cleaning device 40 out of the belt unit frame 61. This facilitates the replacement or maintenance of the conveyor belt 38 and the belt cleaning device 40.

According to the present embodiment, the belt unit 60 including the conveyor belt 38 is removable along the linear insertion/removal path 100 from the main casing 2. In addition, an angle formed between the direction, in which the upper side portion 38*a* of the conveyor belt 38 moves by the drive roller 36, and the direction, in which the belt unit 60 is withdrawn, is such that contacts between the conveyor belt 38 and the photosensitive drums 33 are released by the withdrawal of the belt unit 60.

That is, the upper side portion 38*a* of the conveyor belt 38 is inclined upwardly with respect to the forward direction (the direction of withdrawal of the belt unit 60), and the upper side portion 38*a* contacts the photosensitive drums 33 from their front lower sides. This ensures that the withdrawal or movement of the belt unit 60 in the forward direction releases the contacts between the surface of the conveyor belt 38 and the photosensitive drums 33. Thus, when the belt unit 60 is withdrawn in the forward direction along the linear insertion/removal (horizontal) path 100, the contacts between the surface of the conveyor belt 38 and the photosensitive drums 33 are released as the withdrawal progresses. Accordingly, no additional operation is required to move the belt unit 60 in a direction traversing the horizontal direction in order to separate the conveyor belt 38 from the photosensitive drums 33, and thus the ease of operation during the withdrawal of the belt unit 60 from the main casing 2 can be improved.

When the belt unit 60 is inserted into the main casing 2, on the other hand, installing the belt unit 60 along the linear insertion/removal path 100 ensures that the surface of the conveyor belt 38 comes into contact with the photosensitive drums 33 after the belt unit 60 is installed completely. In this way, the conveyor belt 38 comes into contact with the photosensitive drums 33 after the belt unit 60 has completed moving in the direction along the insertion/removal path. Accordingly, no additional operation of moving the belt unit 60 in a direction crossing or traversing the horizontal direction is required, and thus the ease of operation during the installation of the belt unit 60 into the main casing 2 can be improved.

In this way, no additional motion of the belt unit 60 across the direction of motion along the insertion/removal path 100 is necessary during the insertion or removal of the belt unit 60 with respect to the main casing 2. Accordingly, the configuration for guiding the belt unit 60 can be simplified, enabling a reduction in production costs.

Since the direction in which the belt unit 60 is withdrawn is substantially horizontal, the belt unit 60 can be withdrawn in a simple manner from the main casing 2. This means that the ease of operation of inserting or removing the belt unit 60 can be improved.

In addition, since the belt unit 60 is withdrawn in the direction orthogonal to the rotational shafts 33*a* of the photosensitive drums 33, the contacts between the surface of the conveyor belt 38 and the photosensitive drums 33 can be released immediately after the belt unit 60 has started moving in the direction of withdrawal from the installation position of the belt unit 60. For that reason, sliding contact between the conveyor belt 38 and each photosensitive drum 33 can be prevented. Thus damage to the photosensitive drums 33 or the conveyor belt 38 due to sliding contact between the conveyor belt 38 and the photosensitive drums 33 can be prevented.

The photosensitive drums 33 are arranged parallel with the insertion/removal path 100 of the belt unit 61. The conveyor belt 38 separates from the photosensitive drums 33 simultaneously with one another when the belt unit frame 61 starts moving from the installation position of FIG. 13 in the withdrawal direction.

Since the motion of the belt unit 60 is guided by the belt unit guides 83, the belt unit 60 can be withdrawn in a simple manner from the main casing 2. This enables an improvement in the ease of operation of the insertion and removal of the belt unit 60.

As shown in FIG. 13, the belt unit 60 and the sheet supply cassette 70 are disposed to partly overlap with each other in the direction of withdrawal of the belt unit 60, in other words, horizontally, enabling a reduction in the size of the color laser printer 1 in the horizontal direction.

Additionally, as shown in FIG. 15, the belt unit 60 and the sheet supply cassette 70 are disposed to partly overlap with each other in the direction orthogonal to the direction of withdrawal of the belt unit 60, in other words, vertically, enabling a reduction in the size of the color laser printer 1 in the vertical direction. Additionally, by moving the belt unit 60 in the removal direction, the lower front portion of the belt unit 60 pushes forward the sheet supply cassette 70, thereby enabling the belt unit 60 and the sheet supply cassette 70 to be removed together from the main casing 2.

Furthermore, since the terminals 91 are provided at the end of the belt unit 60 on the downstream side in the direction of installation, the terminals 91 are not exposed until the belt unit 60 has been completely removed from the main casing 2. Thus the user can be prevented from touching the terminals 91.

In addition, since the electrodes 92 are disposed in the main casing 2 on its downstream side in the direction of installation of the belt unit 60, the user can be prevented from touching the electrodes 92. Thus contamination of the terminals 91 and the electrodes 92 can be prevented.

Since the terminals 91 are disposed in an array in the widthwise direction, connections between the plurality of terminals 91 and the electrodes 92 can be achieved simultaneously when the belt unit 60 is installed in the main casing 2.

The terminals 91 and the electrodes 92 are disposed in a positional relationship such that during the installation of the belt unit 60 into the main casing 2, the conveyor belt 38 comes into contact with the photosensitive drums 33 either simultaneously with or after the connections between the terminals 91 and the electrodes 92 are attained. Accordingly, after the conveyor belt 38 has come into contact with the photosensitive drums 33, it is unnecessary to move the belt unit 60 further in the rearward direction to make the connections between the terminals 91 and the electrodes 92. Sliding contacts between the conveyor belt 38 and the photosensitive drums 33 can be prevented. Thus damage to the photosensitive drums 33 or the conveyor belt 38 due to sliding contact between the conveyor belt 38 and the photosensitive drums 33 can be prevented.

When the belt unit 60 is withdrawn from the main casing 2 and the nip of each photosensitive drum 33 and the conveyor belt 38 is released, each transfer roller 39 moves upward due to the elastic force of the compression springs 44. As a result, the upper side portion 38*a* of the conveyor belt 38 moves upward as shown in FIG. 15.

It is noted that the vertical position of each process cartridge 30 is higher by the predetermined amount A than its rear-side neighboring process cartridge 30. When the belt unit 60 is installed in the main casing 2 at the installation position shown in FIG. 13, each transfer roller 39 is urged upwardly by the compression springs 44 (see FIG. 19) and the conveyor belt 38 is sandwiched between each transfer roller 39 and the corresponding photosensitive drum 33. The direction of motion at the start of the withdrawal of the belt unit 60 from the installation position is the horizontal direction, and therefore is orthogonal to the direction in which the transfer rollers 39 are urged by the compression springs 44. Accordingly, when the belt unit 60 is moved forwardly from the installation position to be withdrawn from the main casing 2, the transfer rollers 39 move upward by an amount B due to the elastic force of the compression springs 44, and thus the conveyor belt 38 rises by the amount B upward, that is, in the direction in which the compression springs 44 act.

According to the present embodiment, the offset A between the vertical positions of adjacent image-forming portions 17 in the front-to-rear direction, that is, the offset A between the lower edges of adjacent photosensitive drums 33 has such a value that a value C obtained by subtracting the amount of rise B of the conveyor belt 38 from the offset A is greater than zero. In other words, the offset A is greater than the amount of rise B.

Thus, the belt unit 60 supports each transfer roller 39 in such a manner that the amount of rise B of the conveyor belt 38 at the subject transfer roller 39, which occurs when the belt unit 60 is moved in the forward direction from the installation position, is less than the offset A between the vertical installation positions of image-forming portions 17 that are arranged adjacent to each other in the front-to-rear direction.

For that reason, when the belt unit 60 is moved forwardly from the installation position so as to be withdrawn from the main casing 2, it is ensured that a gap is formed between the conveyor belt 38 and the lower edges of the photosensitive drums 33. The conveyor belt 38 does not contact the lower edges of the photosensitive drums 33. Accordingly, a sliding contact between the conveyor belt 38 and the photosensitive drums 33 can be prevented reliably, even though the conveyor belt 38 rises. As a result, damage to the photosensitive drum 33 or the conveyor belt 38 due to rubbing between the conveyor belt 38 and the photosensitive drums 33 can be prevented.

According to the present embodiment, the plurality of photosensitive drums 33 are arranged along the direction of motion of the conveyor belt 38. The contact between the conveyor belt 38 and the plurality of photosensitive drums 33 is released simultaneously with one another by motion of the belt unit 60 in the direction of withdrawal. Accordingly, no additional operation of moving the belt unit 60 in a direction crossing or traversing the direction of the motion is required, and thus the ease of operation during the removal of the belt unit 60 from the main casing 2 can be improved.

Modifications

In the above-described embodiment, the conveyor belt 38 is made up from a plurality of belt strips, which are arranged in the widthwise direction with inter-strip gaps therebetween. However, the conveyor belt 38 may be comprised of a single conveyor belt with no gaps therebetween.

In this case, each bias line 93 is modified to first extend from the terminal 91 outwardly in the widthwise direction toward the widthwise edge of the conveyor belt 38, then bend upwardly to pass through the gap between the widthwise edge of the conveyor belt 38 and the left-side or right-side plate 65 or 66, before finally reaching the left-side or right-side end of the corresponding transfer roller 39. The bias line 96 may be modified similarly to the bias line 93.

The terminals 91 may further include a terminal for electrically grounding the belt unit frame 61.

Figure 21:
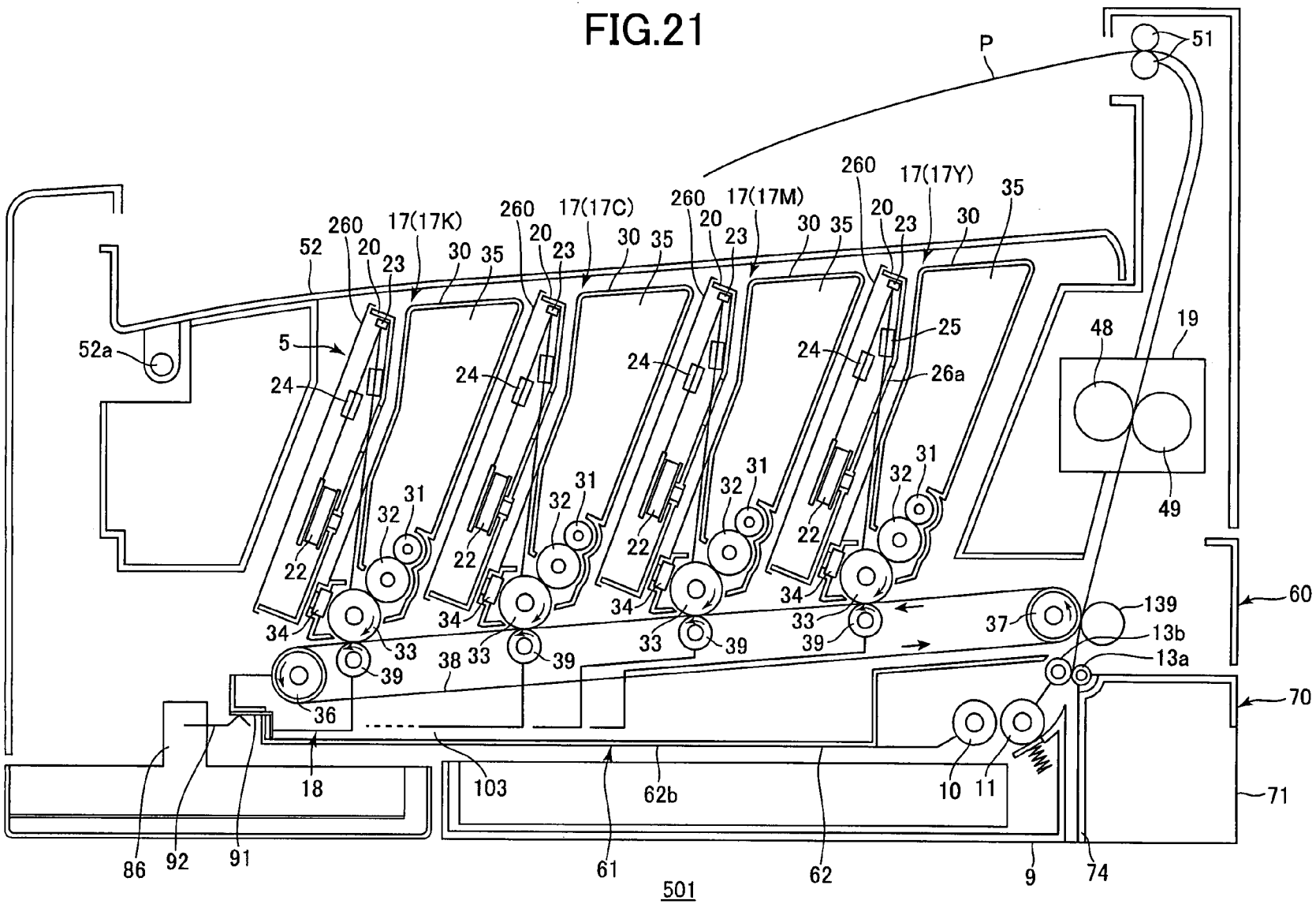
FIG. 21 is a sectional side view of a modification of the third embodiment.

Similarly to the color laser printer 201 according to the modification of the first embodiment, the configuration of the present embodiment can be modified into a color laser printer 501 shown in FIG. 21 such that the conveyor belt 38 acts as an intermediate transfer belt and toner is transferred thereon temporarily, before being transferred to the recording paper P from the conveyor belt 38. In this case, the additional transfer roller 139 is mounted in the belt unit 60.

While the invention has been described in detail with reference to the specific embodiments thereof, it would be apparent to those skilled in the art that various changes and modifications may be made therein without departing from the spirit of the invention.

For example, in the above-described embodiments, images are formed by using four colors of magenta, yellow, cyan, and black. However, images may be formed by using only three colors of magenta, yellow, and cyan, by using only two colors, or by using just one color.

The present invention can be applied to other various different types of image-forming device, such as an image-forming device provided with a facsimile function.

In the above-described embodiments, the photosensitive drum 33 and toner box 35 are exchanged as an integrated process cartridge 30. However, the configuration could be modified such that only the toner box 35 can be exchanged. More specifically, the process cartridge 30 may be configured from a combination of a developer cartridge and a drum cartridge. The developer cartridge may include the toner box 35, the supply roller 31, and the developer roller 32, while the drum cartridge may include the photosensitive drum 33. The developer cartridge can be detachably engaged with the drum cartridge. The developer cartridge may be detached from the drum cartridge and removed from the main casing 2, while the drum cartridge is being mounted in the main casing 2.

In the first embodiment, the image forming portions 17 for black, cyan, yellow, and magenta are arranged in this order from rear to front. In the second embodiment, the image forming portions 17 for black, cyan, magenta, and yellow are arranged in this order from rear to front. However, the image forming portions for these four colors may be arranged in any other orders.

In the first embodiment, the combination of the protrusion 27 and the depression 262 is located on one end of the scanner housing 26 in the scanning direction to regulate the one end of the scanner unit 20 not to contact the support frame 260, while the screw 263 is located on the other end of the scanner housing 26 in the scanning direction to adjust the distance between the left end of the scanner unit 20 and the support frame 260. However, the combination of the protrusion 27 and the depression 262 may be located at a location that is nearer to one end than the other end in the scanning direction, and the screw 263 may be located at a location that is nearer to the other end than the one end in the scanning direction.

Similarly, in the second embodiment, the leaf spring 261 is located on one end of the scanner frame 326 in the scanning direction, while the screw 363 is located on the other end of the scanner frame 326 in the scanning direction. However, the leaf spring 261 may be located at a location that is nearer to the one end of the scanner frame 326 than the other end in the scanning direction, and the screw 363 may be located at a location that is nearer to the other end of the scanner frame 326 than the one end in the scanning direction.

In the first and third embodiment, the combination of the protrusion 27 and the depression 262 is used for regulating the scanner unit 20 not to contact the support frame 260, while the screw 363 is used for adjusting the distance between the scanner unit 20 and the support frame 260. In the second embodiment, the combination of the rotational shaft 329 and the bearing portion 360*d* is used for regulating the scanner unit 320 not to contact the support frame 360, while the screw 363 is used for adjusting the distance between the scanner unit 320 and the support frame 360. However, other various arrangements can be used to regulate the scanner unit not to contact the support frame, and to adjust the distance between the scanner unit and the support frame.

What is claimed is:

1. A scanner unit comprising:

a scanner housing;

a laser diode that is disposed at the scanner housing and emits a laser beam;

a polygon mirror that is disposed at the scanner housing and deflects the laser beam from the laser diode in a scanner direction so that the laser beam deflected by the polygon mirror scans on a photosensitive drum; and at least one reflective mirror that is disposed at the scanner housing and that reflects the laser beam from the polygon mirror;

a sensor that is disposed at the scanner housing and receives the laser beam from the reflective mirror;

wherein the polygon mirror is located on an optical path of the laser beam between the reflective mirror and the sensor, and a rotational period and a rotational timing of the polygon mirror are set to ensure that while the laser beam falls incident on the reflective mirror, the angular edges of the polygon mirror will not be in the optical path.

2. The scanner unit claimed in claim 1, further comprising:

an optical lens that passes the laser beam from the polygon mirror, wherein the optical path is positioned at an opposite side of the polygon mirror with respect to the optical lens.

3. The scanner unit claimed in claim 1, wherein the laser beam falls incident on the reflective mirror when the reflective surface of the polygon mirror is parallel to the optical path.

4. The scanner unit claimed in claim 1, wherein the scanner housing has a support member that supports the polygon mirror and that extends perpendicularly, to a rotational axis of the polygon mirror, and the laser diode and the sensor are positioned in a same region among four regions into which the support member is divided equiangularly around the rotational axis of the polygon mirror.

5. The scanner unit claimed in claim 1, wherein the laser beam is reflected at least twice by the reflective mirror between the polygon mirror and the sensor.

6. The scanner unit claimed in claim 1, wherein the sensor generates a signal to determine a timing at which a laser beam has started scanning on the photosensitive drum.

7. A scanner unit comprising:

a scanner housing;

a first, second and third reflective mirror that are disposed in the scanner housing;

a laser diode that is disposed in the scanner housing and emits a laser beam, the laser beam arranged to reflect off the first reflective mirror;

a polygon mirror having angular edges, a reflective surface and being disposed in the scanner housing, the polygon mirror deflecting the laser beam from the first reflective mirror in a scanner direction so that the laser beam deflected by the polygon mirror scans on a photosensitive drum and reflects off the second reflective mirror onto the third reflective mirror, a sensor that is disposed in the scanner housing and receives the laser beam from the third reflective mirror;

wherein the polygon mirror, located on an optical path of the laser beam between the third reflective mirror and the sensor, has a rotational period and a rotational timing which ensure that while the laser beam falls incident on the third reflective mirror, the angular edges of the polygon mirror are not in the optical path between the third reflective mirror and the sensor.

8. The scanner unit according to claim 7, further comprising:

an optical lens that passes the laser beam from the polygon mirror, wherein the optical path is positioned at an opposite side of the polygon mirror with respect to the optical lens.

9. The scanner unit according to claim 7, wherein the laser beam falls incident on the third reflective mirror when the reflective surface of the polygon mirror is parallel to the optical path between the third reflective mirror and the sensor.

10. The scanner unit according to claim 7, wherein the scanner housing has a support member that supports the polygon mirror and extends perpendicular to a rotational axis of the polygon mirror.

11. The scanner unit according to claim 10, wherein the rotational axis of the polygon mirror defines four equiangular regions on the support member.

12. The scanner unit according to claim 11, wherein the laser diode and the sensor are positioned in a same region of the four regions.

13. The scanner unit according to claim 7, wherein the sensor generates a signal to determine a timing at which a laser beam has started scanning on the photosensitive drum.

* * * * *

UNITED STATES PATENT AND TRADEMARK OFFICE

CERTIFICATE OF CORRECTION

PATENT NO. : 7,804,515 B2
APPLICATION NO. : 12/320328
DATED : September 28, 2010
INVENTOR(S) : Yasuo Tamaru et al.

It is certified that error appears in the above-identified patent and that said Letters Patent is hereby corrected as shown below:

On the Title Page

Item (75), please delete "Hiroshi Igarashi, Nagoya (JP); Yasushi Okabe, Nagoya (JP)."

Signed and Sealed this
Twenty-eighth Day of December, 2010

David J. Kappos

David J. Kappos
*Director of the United States Patent and Trademark Office*